US006652214B1

(12) United States Patent
Barry

(10) Patent No.: US 6,652,214 B1
(45) Date of Patent: Nov. 25, 2003

(54) CONTAINER OBLIQUE-CHANNEL TRANSFER AND SYSTEM

(76) Inventor: Leonard D. Barry, 19300 Pennington Dr., Detroit, MI (US) 48221

( * ) Notice: Subject to any disclaimer, the term of this patent is extended or adjusted under 35 U.S.C. 154(b) by 0 days.

(21) Appl. No.: 09/913,145

(22) PCT Filed: Feb. 9, 2000

(86) PCT No.: PCT/US00/03400

§ 371 (c)(1),
(2), (4) Date: Aug. 9, 2001

(87) PCT Pub. No.: WO00/47461

PCT Pub. Date: Aug. 17, 2000

Related U.S. Application Data

(63) Continuation-in-part of application No. 09/623,621, filed on Aug. 31, 2000.

(60) Provisional application No. 60/119,297, filed on Feb. 9, 1999, provisional application No. 60/149,590, filed on Aug. 18, 1999, and provisional application No. 60/161,836, filed on Oct. 27, 1999.

(51) Int. Cl.[7] ..... B61D 47/00

(52) U.S. Cl. ..... 414/337; 414/334; 414/338

(58) Field of Search ..... 414/334, 337, 414/338

(56) References Cited

U.S. PATENT DOCUMENTS

| | | | |
|---|---|---|---|
| 1,313,091 | A | 8/1919 | Lamar |
| 1,383,220 | A | 6/1921 | Lamar |
| 3,471,043 | A | 10/1969 | Kemp et al. |
| 3,548,756 | A | 12/1970 | Fujioka |
| 4,124,129 | A | 11/1978 | Barry |
| 4,130,208 | A | 12/1978 | Barry |

*Primary Examiner*—Steven A. Bratlie
(74) *Attorney, Agent, or Firm*—Gifford, Krass, Groh, Sprinkle, Anderson & Citkowski, P.C.

(57) ABSTRACT

This is a slide, roller-bed, magnlev, or fluid lift side transfer platform system for transfer of transport or cargo containers from and to railway cars, motor trucks or conveyor and a dock. The container has transfer arms that extend or lock into corner castings on a side and can be hinged to swing down to position wheels on the arms to track in parallel channels slanted obliquely out away from the car to pull the container out parallel as the train moves to dock the container. The car is moved in the opposite direction to receive the container. The car can extend a push arm to engage the container or a starter to accelerate the container to train speed at alignment for it to be pushed along the oblique channels parallel into an empty berth on the train. The accelerator arm can retard a container pushed out from the moving train. Roll up-down side doors on the car operate the transfer arms to raise and lower with the lower door and secure the container in place when closed. Powered roller conveyors accumulate and position containers on the dock. The containers can be transferred between the dock and trucks or semitrailers and transfer arms removed or retracted before highway operation of the trucks. The containers can be auto carriers for transfer from and to trains inroute. Small mail and express containers fit rail car and trailer widths and offer drive through loading.

29 Claims, 13 Drawing Sheets

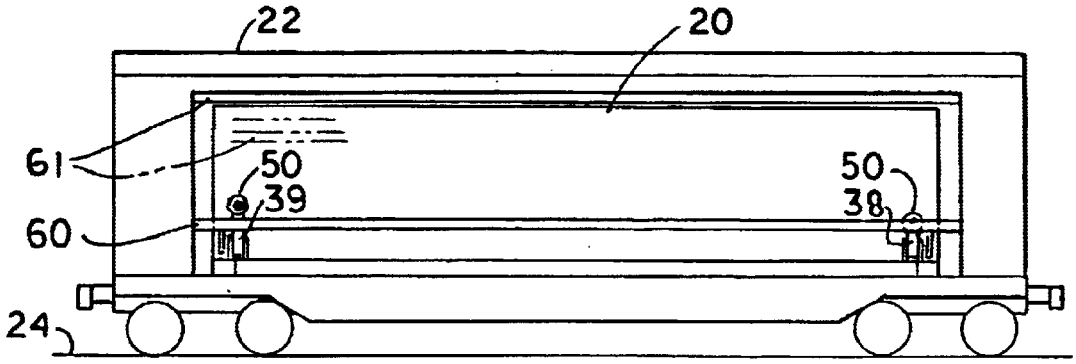
FIG. 5
FIG. 6
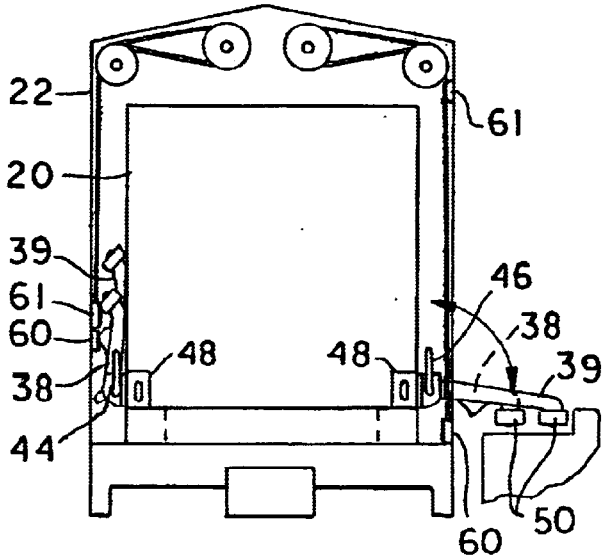
FIG. 7
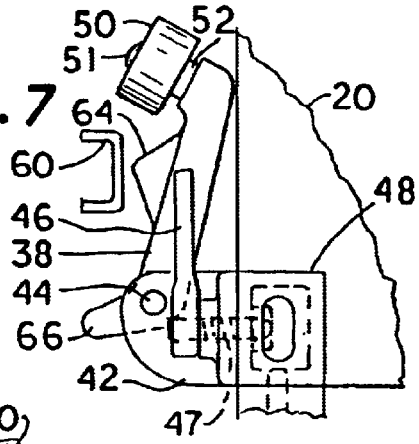
FIG. 8
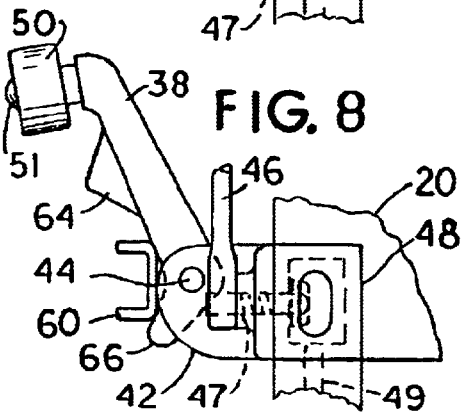
FIG. 10
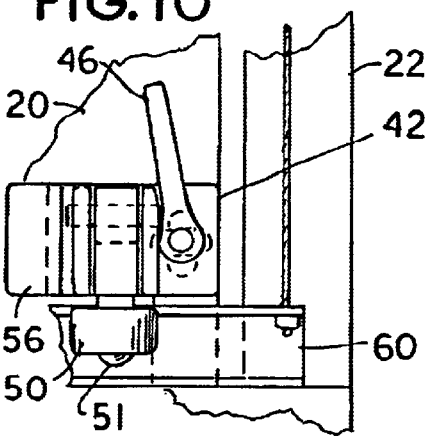
FIG. 9
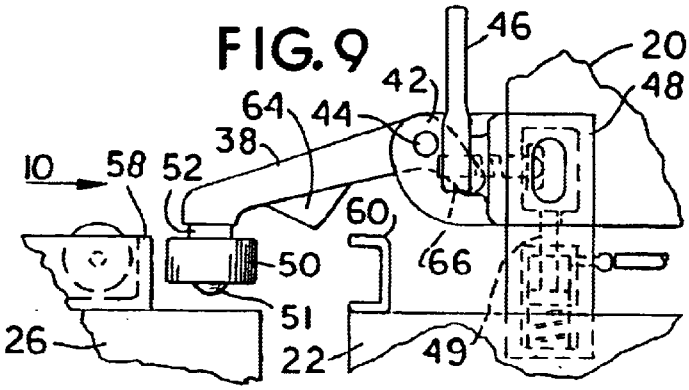

20B
38B
50
26

34
50
22
20B
34
26

160
161
50
20B
50
34D
160
161

20B
161
80
160

20P
170
176
177
22P
172
164
169
39P
38P
50

172
168
164
169
166
174
190
50
38P
34
30P
24
20P
191
39P
50
174
164
168
166
169
172
22P

B
164
DL
20P
194
50
38P
39P
26L
190
191
30P
174
168
169
170
172
177
34
180
182
184
186

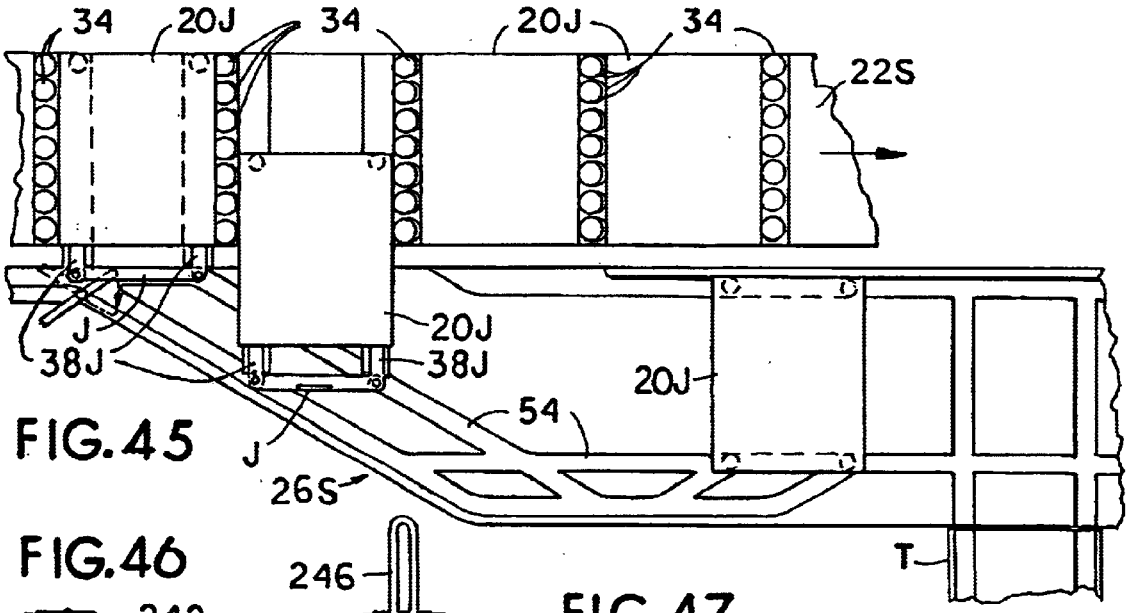
FIG. 45
FIG. 46
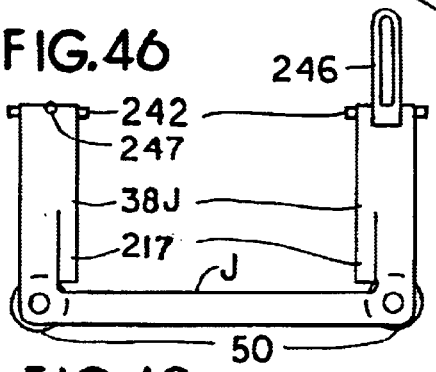
FIG. 47
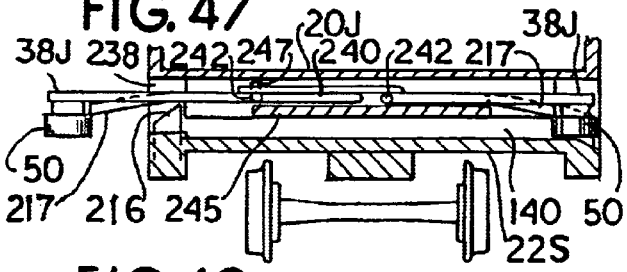
FIG. 48
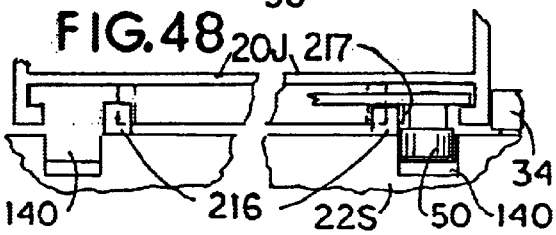
FIG. 49
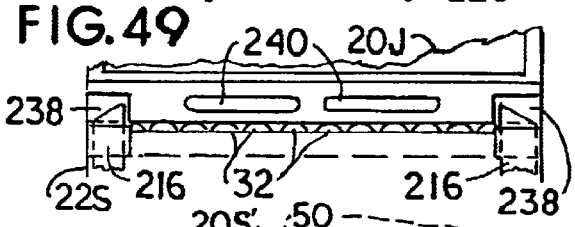
FIG. 50
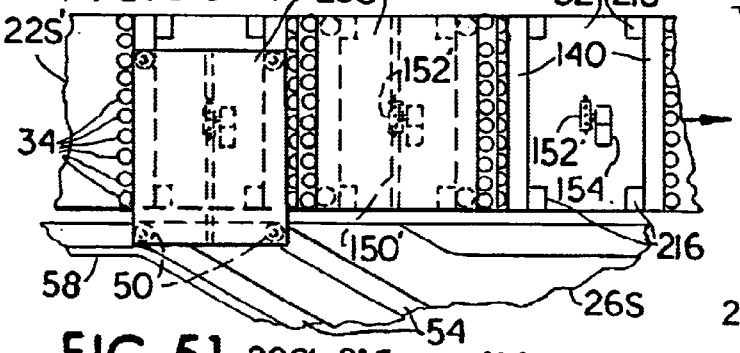
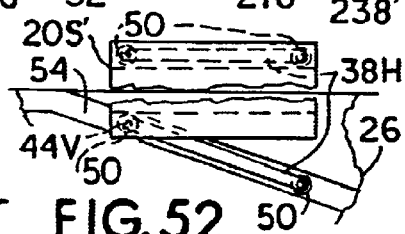
FIG. 52
FIG. 53
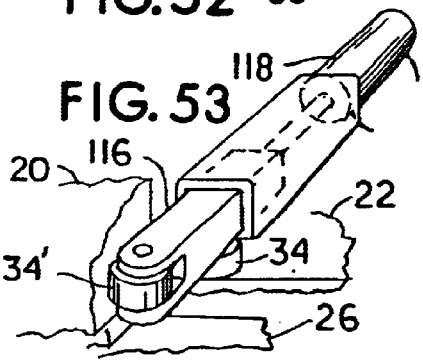
FIG. 51
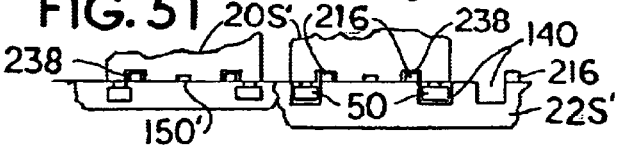

CONTAINER OBLIQUE-CHANNEL TRANSFER AND SYSTEM

CROSS REFERENCE TO RELATED PATENTS

This application corresponds to my U.S. provisional applications No. 06/119,297 filed Feb. 9, 1999, No. 60/149,590 filed Aug. 18, 1999; and No. 60/161,836 filed Oct. 27, 1999, and is a continuation in part of my pending U.S. application Ser. No. 09/623,621 filed Aug. 31, 2000.

This is a side transfer platform and system for transferring transport containers to and from the platform and cars in a train (either one or both are moving) and between trucks, trailers, or buses with relative movement alongside of the platform. This invention includes storage for containers for successive transfers and accelerating pushers to align containers at speed with a car for transfer thereto.

It is an object to provide a simple and cheap transfer system that eliminates the crane or rotary lift of my prior systems and instead uses platforms with parallel oblique channel tracks and arms with wheels for riding and guiding in the channels to pull or push in or out the containers using the momentum of the train or vehicle.

It is an object to provide easily detachable transfer arms on existing cargo containers to engage in the channels for transfer. It is an object to provide side transfer arms which are twist locked tight to the container corner castings. A related object is to provide transfer arms that swing tip and out of the way on the containers for clearance on the cars.

An object of this invention is to provide safe nonstop roll-off roll-on transfer of cargo containers from the side of a car especially a car that has a roof over the container berth. It is an object to provide on the car with roof over the container area roll up-down side doors which part longitudinally aways up the side of the car to open up and down and provide side transfer arms which are twist locked tight to the container corner castings to swing down when the doors are opened to extend from the side of the car to engage in diagonal channel tracks to carry the container parallel out and away from the car as pushed by the car. It is an object to fully enclose the car to keep snow and ice out and extend and retract the transfer arms with the doors.

Another object is to provide smooth acceleration of a standing container to align for transfer in a short distance, and further to provide a pusher moved by an acceleration arm pivoted to rotate by movement of the train to accelerate the container to align at train speed for transfer.

It is an object to provide a roller bed or skid platform dock with oblique parallel transfer channels or track for transfer of containers to or from the train and dock and truck and dock on the same or preferably opposite sides of the dock. Another object is to provide accumulating conveyors run parallel to the channels for retarding, moving, storing, and accelerating the containers selectively.

It is an object also to provide an oblique-channel dock and system for transfer of small containers to be carried side by side on the railway cars and end to end on trucks. It is an object to provide transfer arms mounted central on the bottom of these containers for the length thereof to be extended to engage dock channels on either side of the car. It is an object that ends of these containers fit flush with the car sides and the car have doors to close off empty container berths.

It is an object to eliminate friction of the container on the platform by means such as magnetic levitation or air or fluid levitation of the container for transfer on the dock.

It is an object to provide passenger container transfer between train and bus.

It is an object to provide enclosed container cars to streamline the train and open for transfer of containers nonstop.

A further object is to place the channel dock on a vehicle to move alongside of a standing or moving train or vehicle at a speed for transfer either to or from the dock.

It is an object to provide these transfer containers for passengers, vehicles of the passengers, mail, express, and freight.

It is also an object to provide this for material handling or as a transfer device for amusement rides, miniature railways, or toys.

These, other and further objects and features should become evident to those skilled in the art by study of this application with reference to the drawings wherein:

FIG. 5 is a side view of the railroad car with container.

FIG. 6 is a partial end sectional view of the car with container to larger scale.

FIGS. 7, 8 and 9 are end comer successive views of the container on the car with a transfer arm being lowered.

FIG. 10 is a corner side view taken in direction 10 of FIG. 9.

Figure 13:
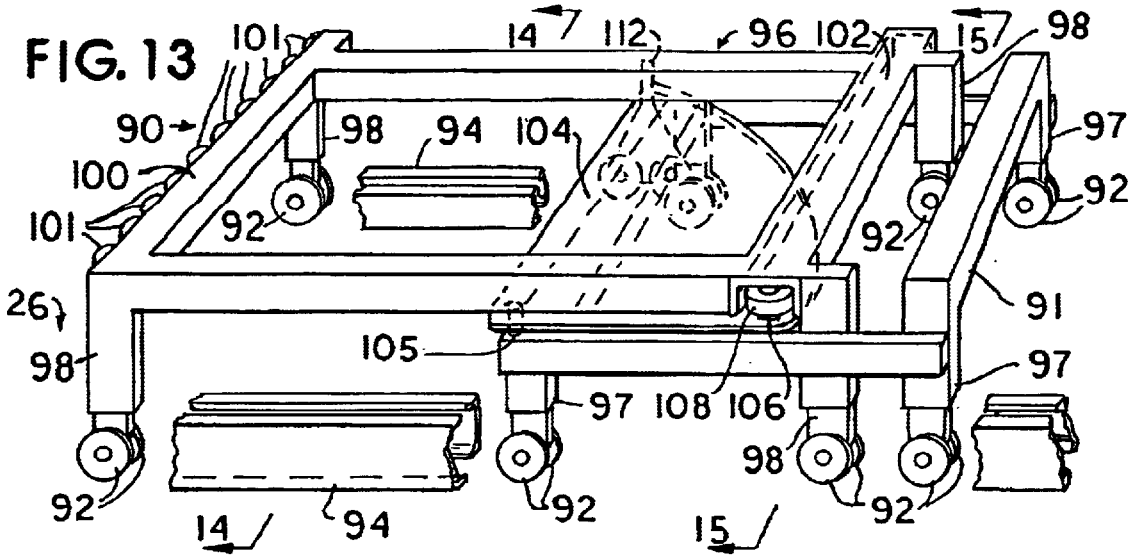
FIG. 13 is a perspective view of the accelerator.
Figure 14:
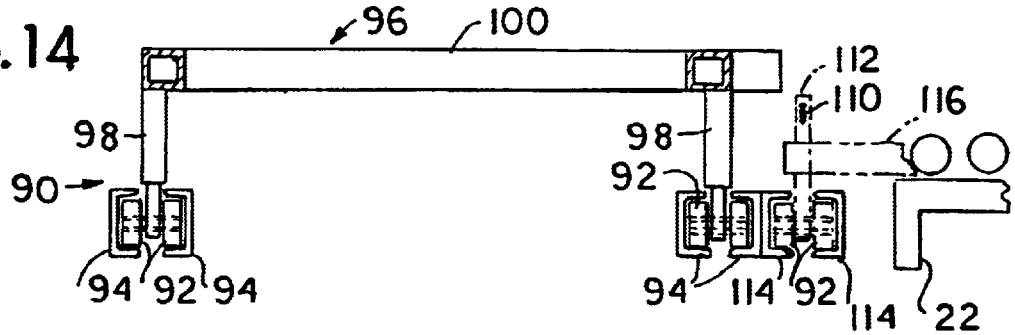
Figure 15:
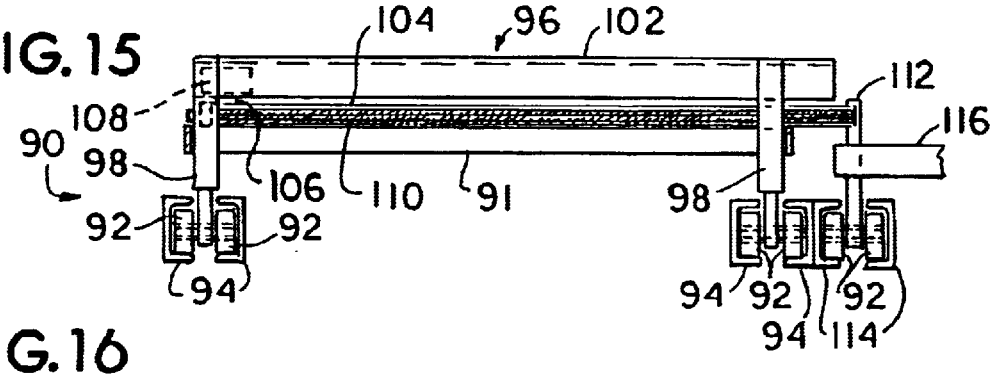

FIGS. 14 and 15 are sectional views taken respectively on lines 14—14 and 15—15 of FIG. 13.

Figure 16:
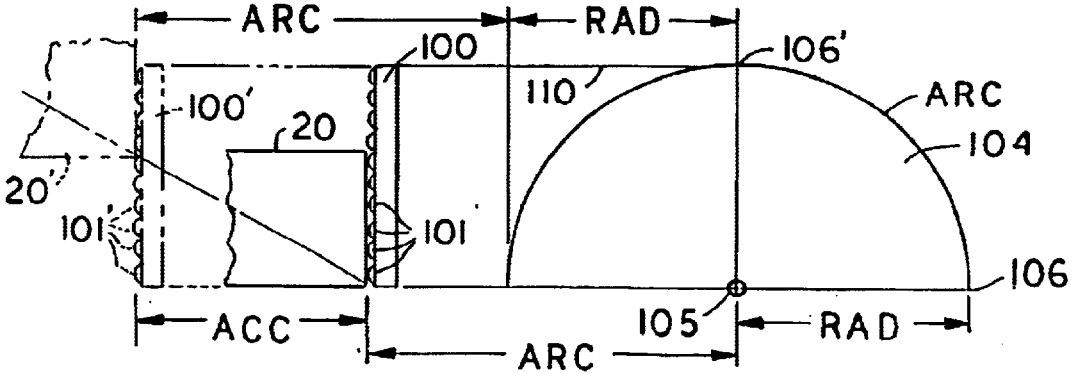

FIG. 16 is accelerator diagram, start to train speed positions.

Figure 17:
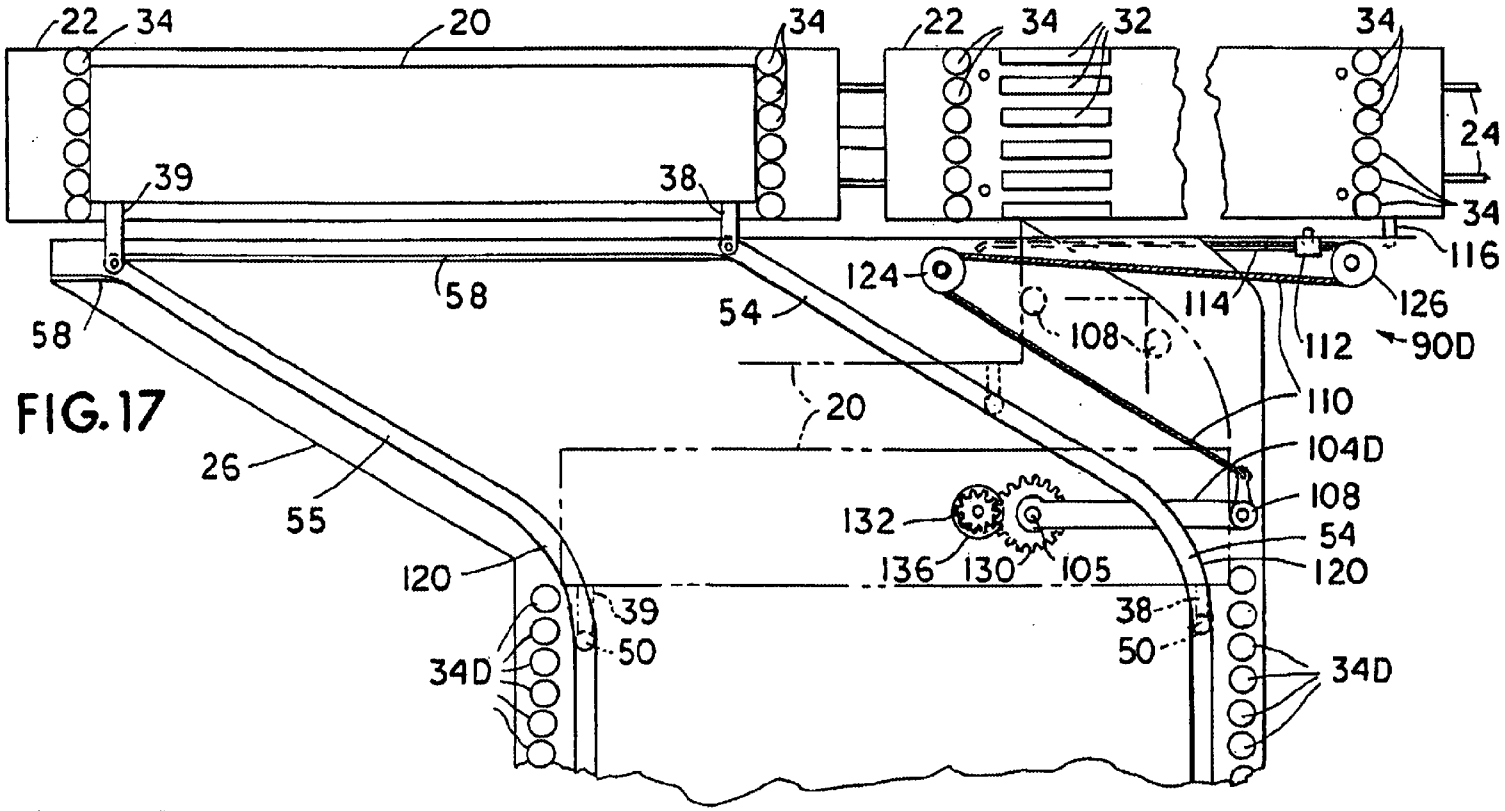
Figure 18:
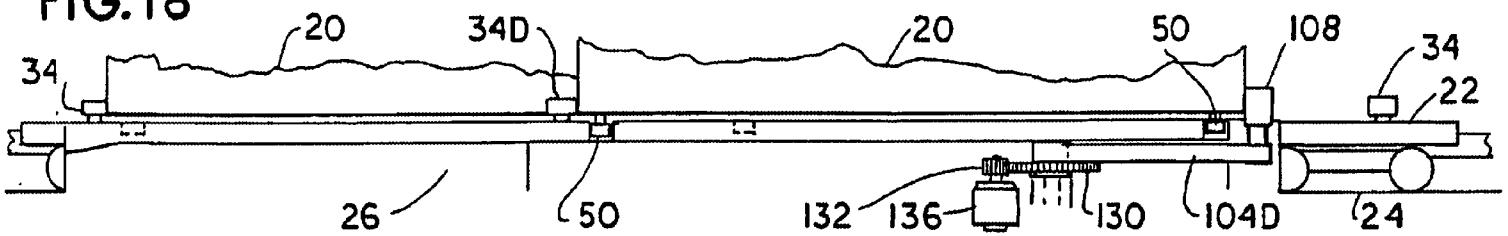

FIGS. 17 and 18 are respectively plan and side elevations of cars in the train passing an oblique-channel station with curved channels to align containers side by side, magnetic levitation, and a simplified accelerating arm.

Figures 19, 20, 21, 22:
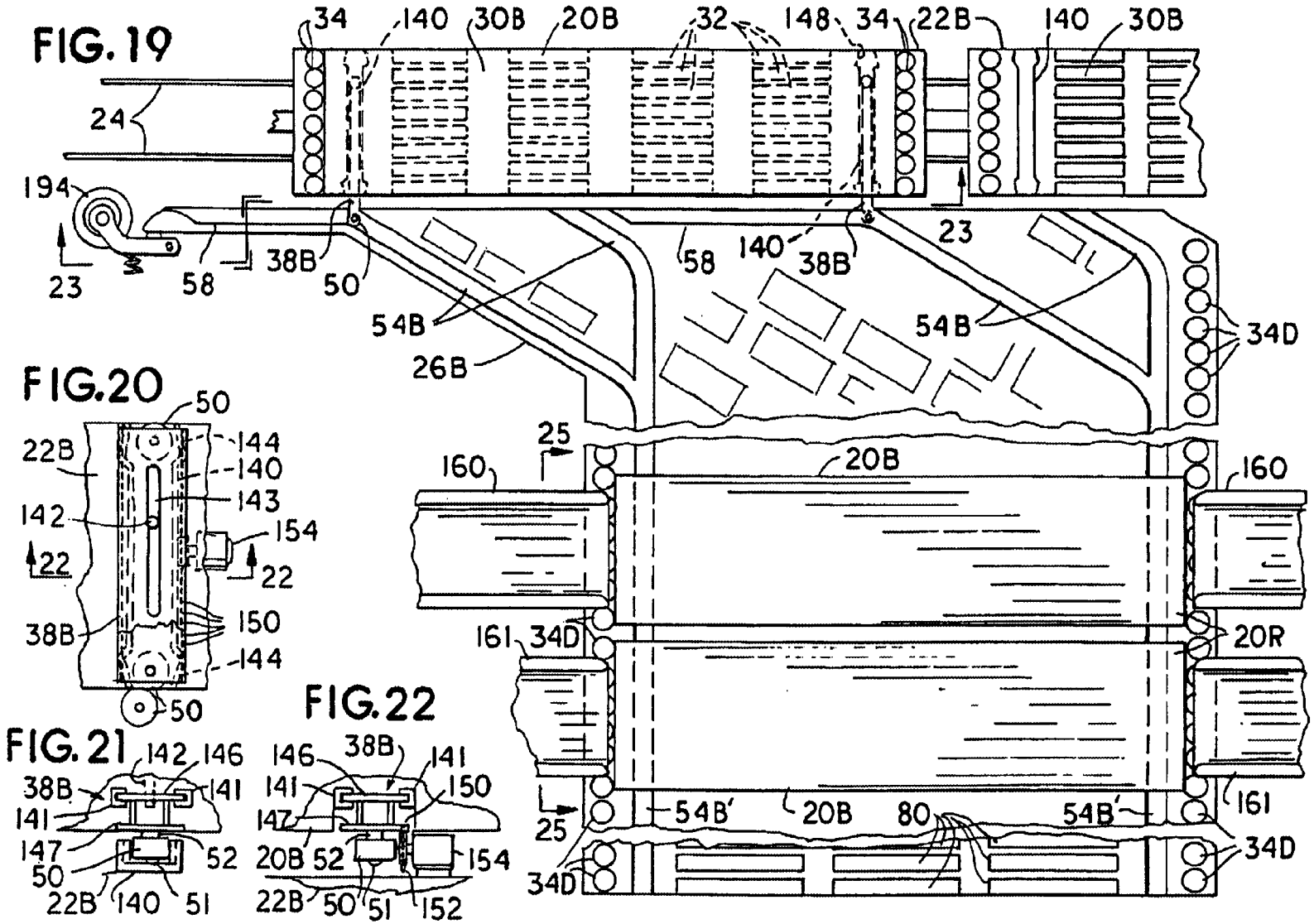

FIG. 19 is a plan view of a variation of the station, rail cars, and containers.

FIGS. 20 and 21 are respectively plan and end elevation views of a transfer arm in FIG. 19 with portions of the container and car to larger scale.

FIGS. 22 is a sectional elevation taken on line 22—22 of FIG. 20.

Figures 23, 24, 25, 26, 27, 28:
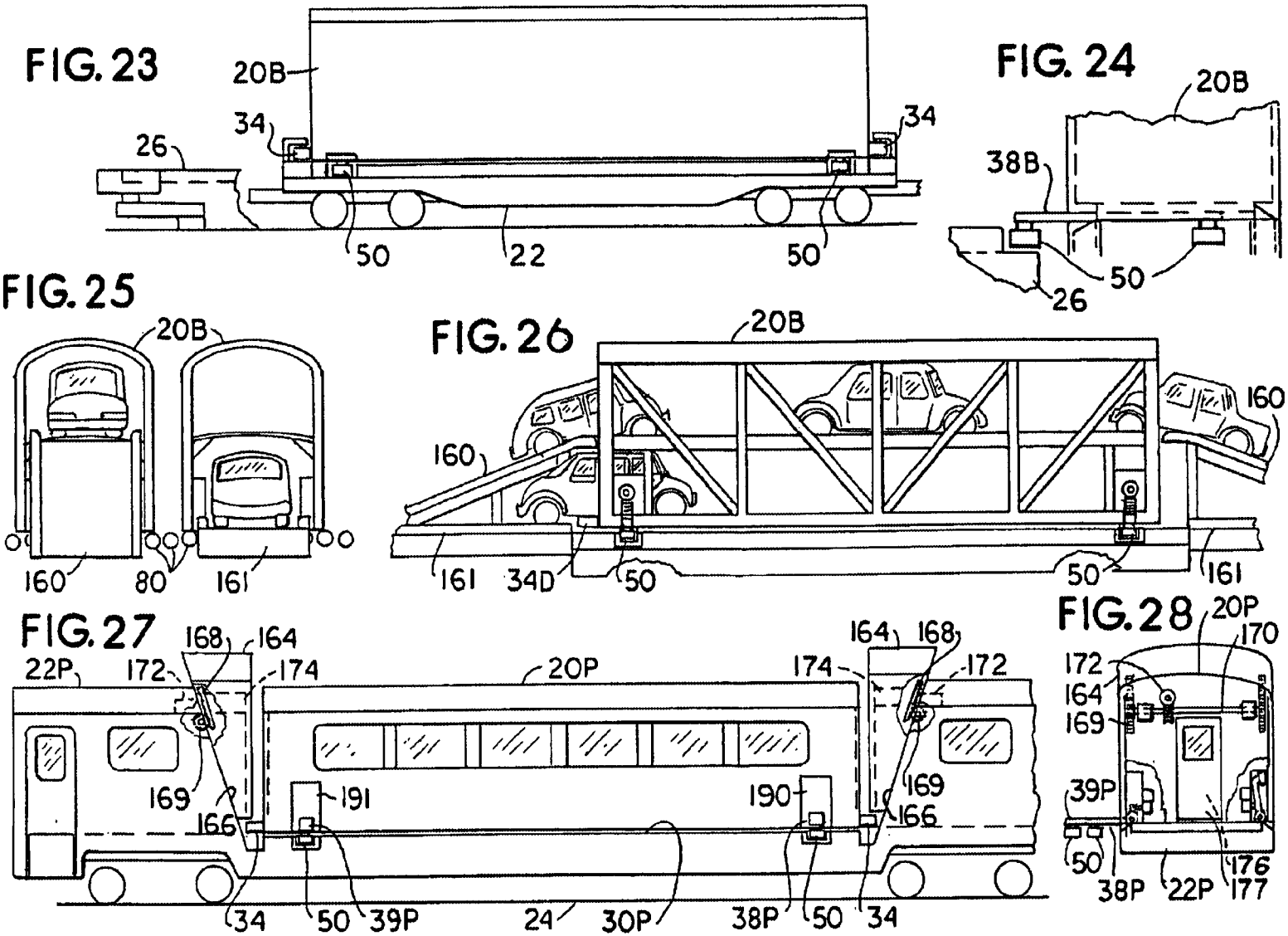

FIG. 23 is a side elevation taken on line 23—23 of FIG. 19.

FIG. 24 is a partial end sectional elevation of FIG. 23, to larger scale, showing a transfer arm extended.

FIGS. 25 and 26 are respectively end and side elevations of auto-rack containers at the station, FIG. 19, with autos being loaded and unloaded.

FIGS. 27 and 28 are respectively side and end elevations of a passenger car with container with end hoods lifted for clearance for transfer.

Figures 29, 30, 31, 32, 33:
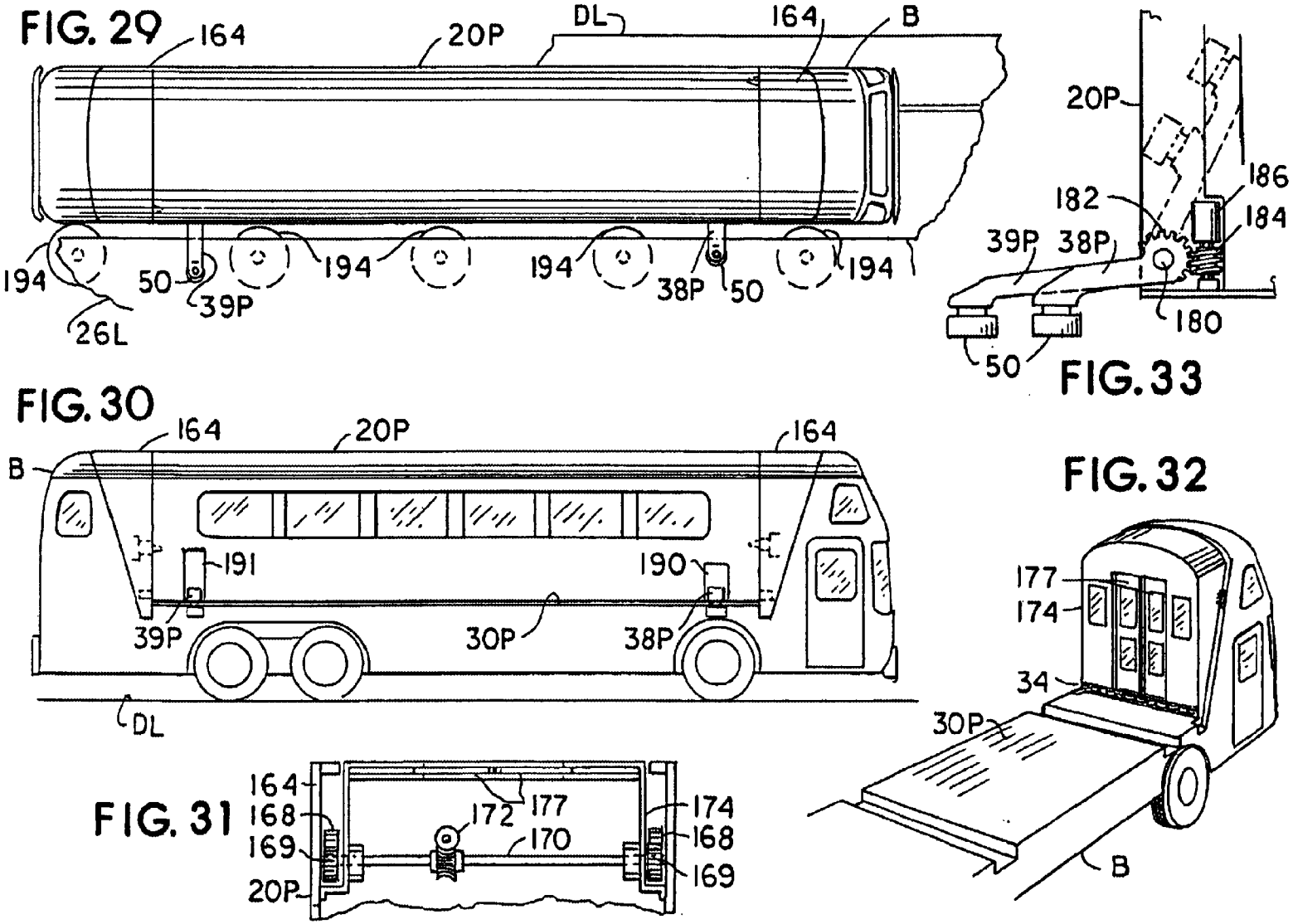

FIG. 29 is a top view of a bus with the passenger container on a driveway along a station transfer platform.

FIG. 30 is a side view of the bus with container of FIG. 29.

FIG. 31 is a sectional plan view of a hood on the bus or car.

FIG. 32 is a perspective view of an end of the berth on the bus.

FIG. 33 is a side view of transfer arms on the container.

Figure 34:
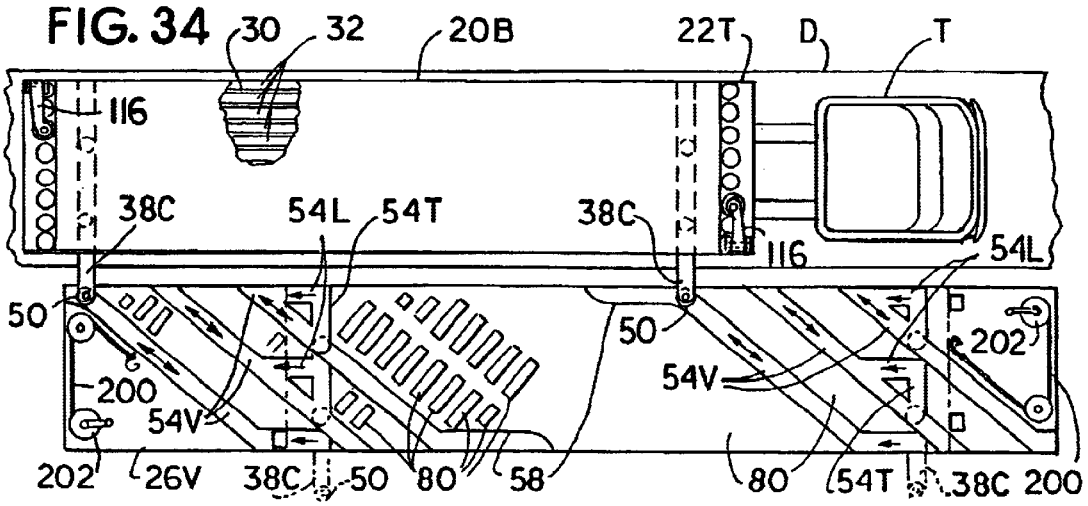

FIG. 34 is a plan view of a semitrailer with container engaging an oblique-channel transfer vehicle or railway car.

Figure 35:
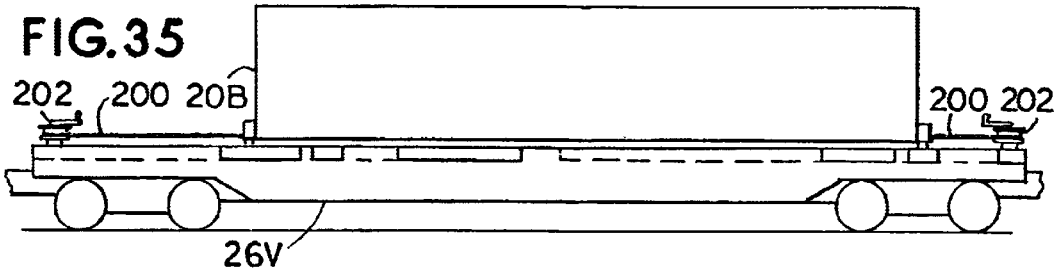

FIG. 35 is a side elevation of the near vehicle in FIG. 34.

Figure 36:
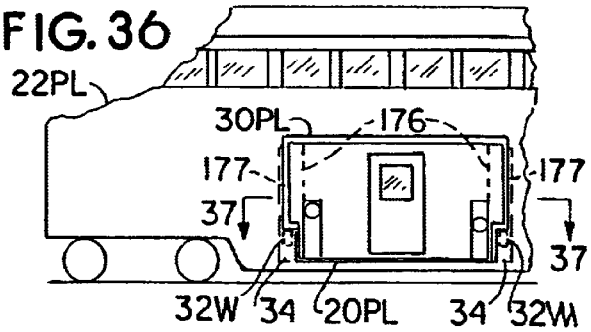

FIG. 36 is a partial side view of a two-level passenger car with transfer compartment on the lower level.

Figure 37:
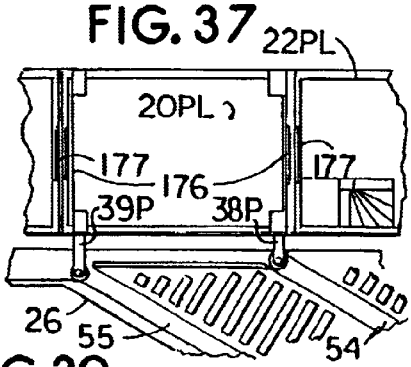

FIG. 37 is a sectional plan on line 37—37 of FIG. 36 at station.

Figure 38:
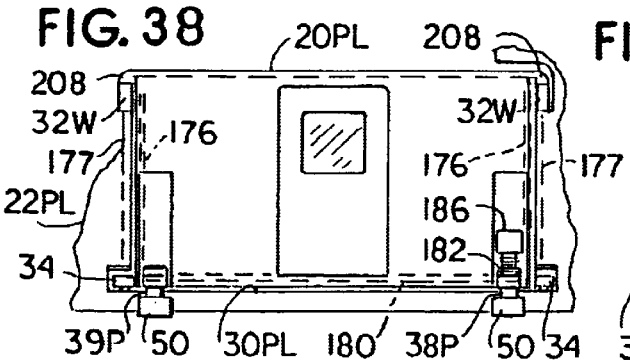

FIG. 38 is a side view of the container on the car to larger scale.

Figure 39:
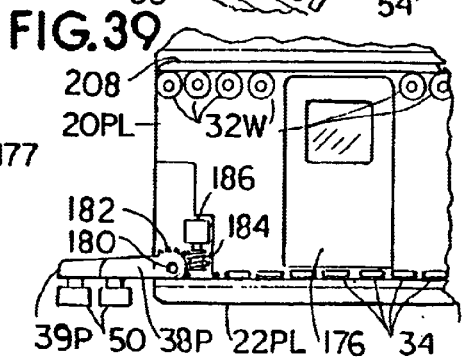

FIG. 39 is a partial end view of FIG. 38 crosswise the car.

Figures 40, 41, 42, 43, 44:
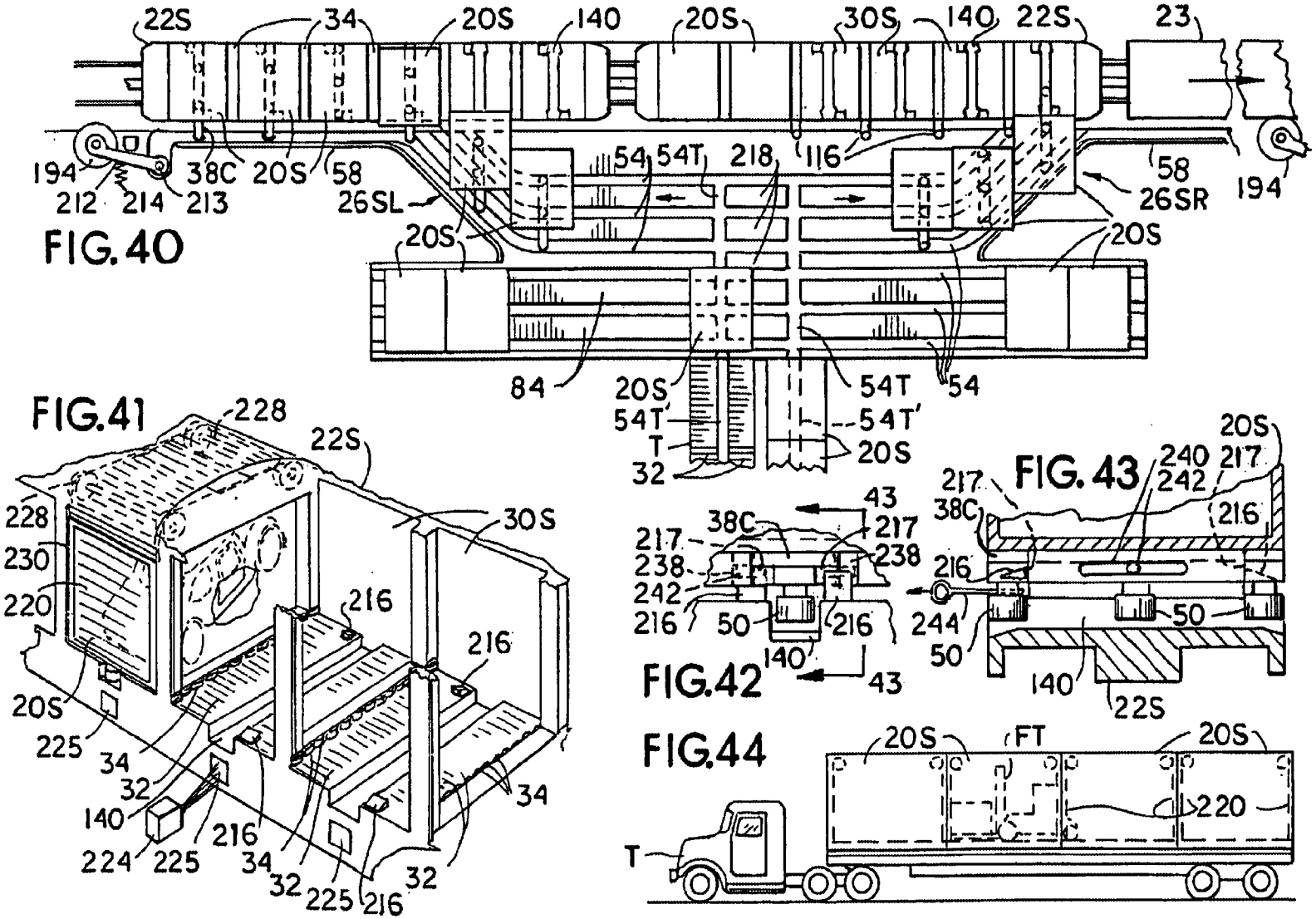

FIG. 40 is a plan view of a station with small containers that are channeled crosswise on cars and lengthwise on trucks.

FIG. 41 is a perspective view of a section of a car in FIG. 40 with a container with auto, empty berths, and schematic control.

FIG. 42 is an end view of the transfer arm in a container on the car.

FIG. 43 is a sectional elevation on lines 43—43 of FIG. 42.

FIG. 44 is a side elevation of a semitrailer loaded with these containers with connecting doors open for loading in series by a fork truck.

FIG. 45 is a partial plan view of a variation of the station with small containers being transferred from a car in the train.

FIG. 46 is a top view of a transfer arm for the container of this station.

FIG. 47 is a transverse sectional view of a car with container extending its left arms.

FIG. 48 is a partial side view along the car with container having its left arm removed.

FIG. 49 is a partial sectional view aligned with FIGS. 47 and 48 showing a portion of the car and container with arms removed to show the locking latches.

FIG. 50 is a partial plan of containers having bottom mounted channel rollers one transferring between the car and platform.

FIG. 51 is a side elevation of a portion of the car with containers of FIG. 50 aligned.

FIG. 52 is a plan view of a container end with a horizontally extended arm engaging a dock channel.

FIG. 53 is a perspective view of a pusher arm for the vehicle to push a container for transfer with the vehicle.

Figure 54:
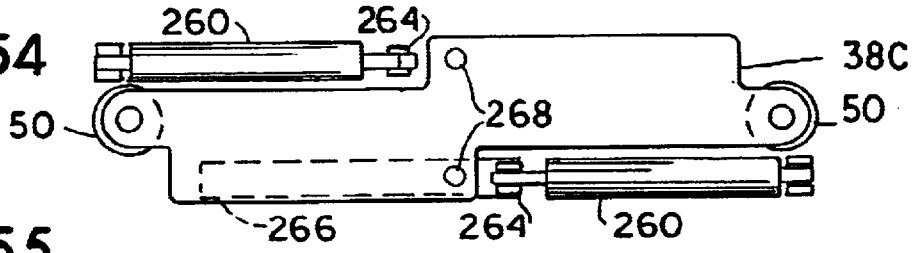
Figure 55:
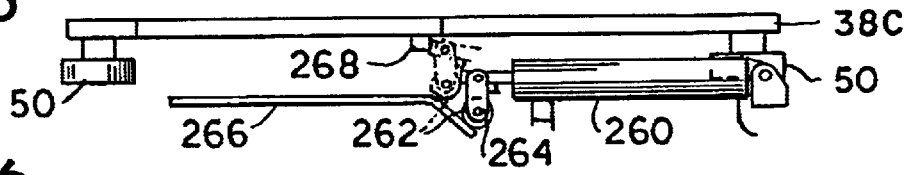

FIGS. 54 and 55 are plan and side views of a transfer arm and extending mechanism.

Figure 56:
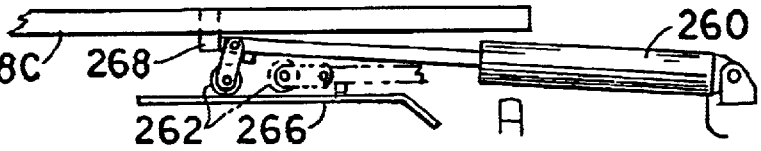

FIG. 56 is a view of FIG. 55 when extended.

Figure 57:
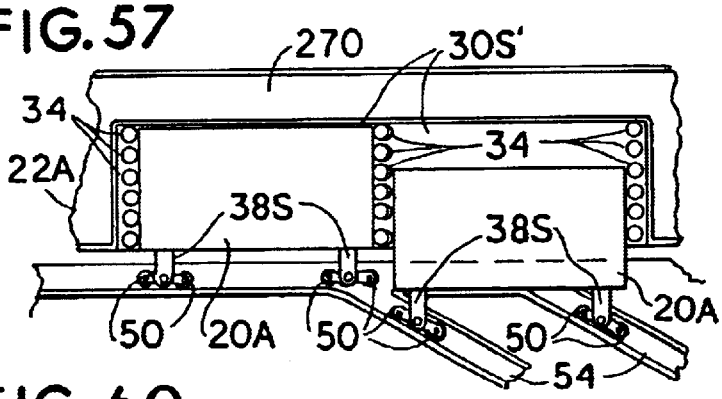

FIG. 57 is a plan view of an aisle car transferring containers.

Figure 58:
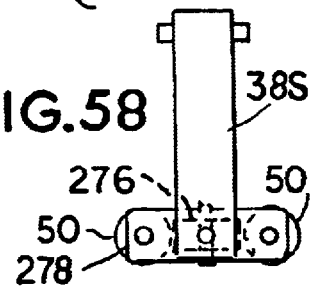
Figure 59:
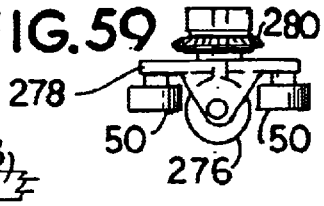

FIGS. 58 and 59 are plan and end views of a preferred transfer arm.

Figure 60:
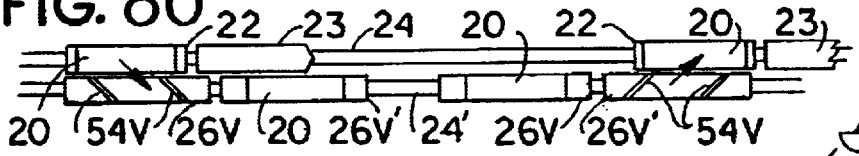

FIG. 60 is a plan for at speed transfers.

Figure 61:
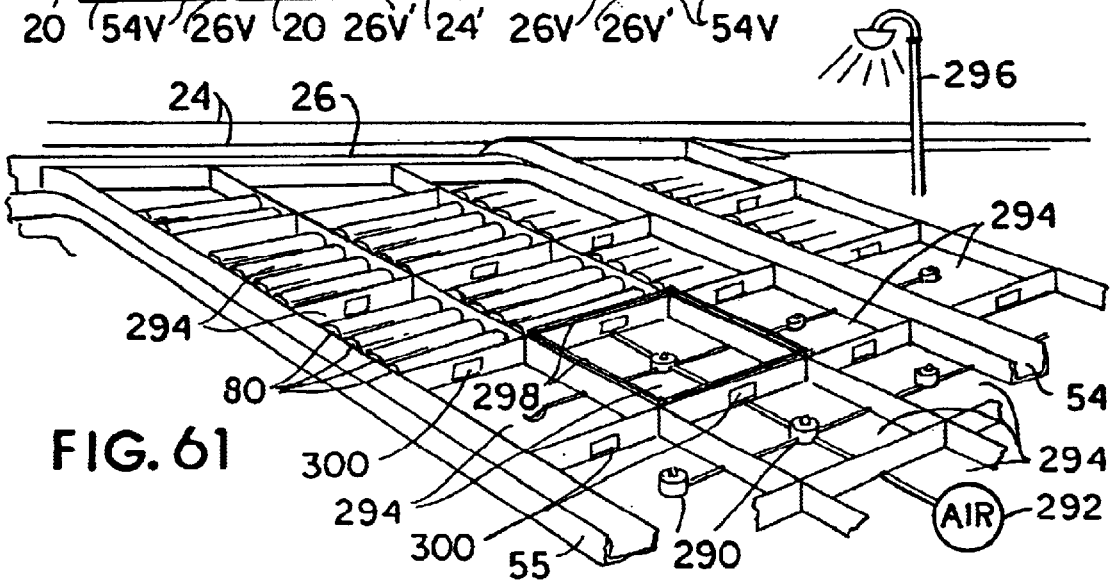

FIG. 61 is a perspective plan for on platform air levitation.

Figure 1:
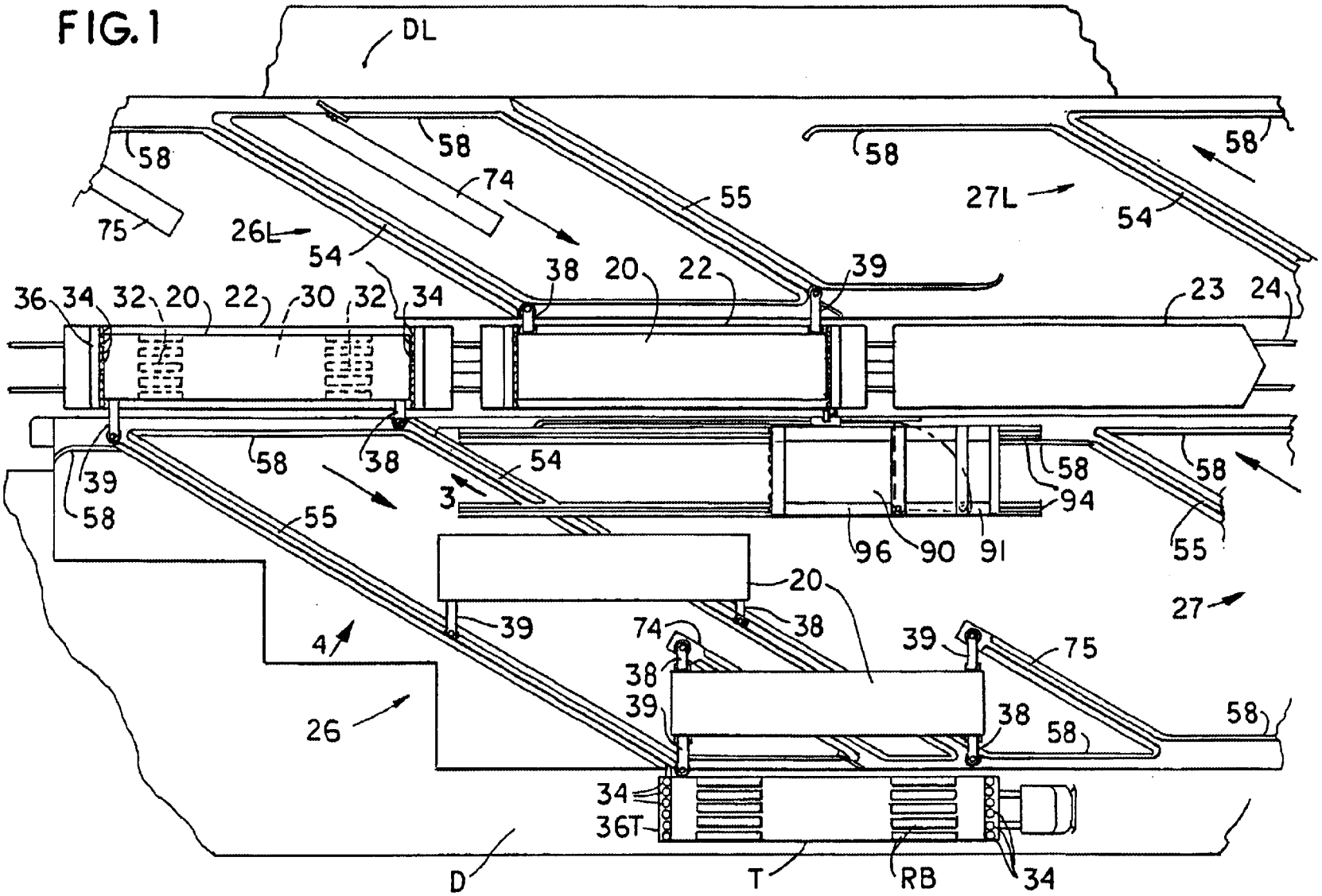
FIG. 1 is a plan view of a transfer station with channel platforms along both sides of a track with car in train transferring a cargo container out and another put in the train moving left to right and a semitrailer ready to load a container.
Figure 2:
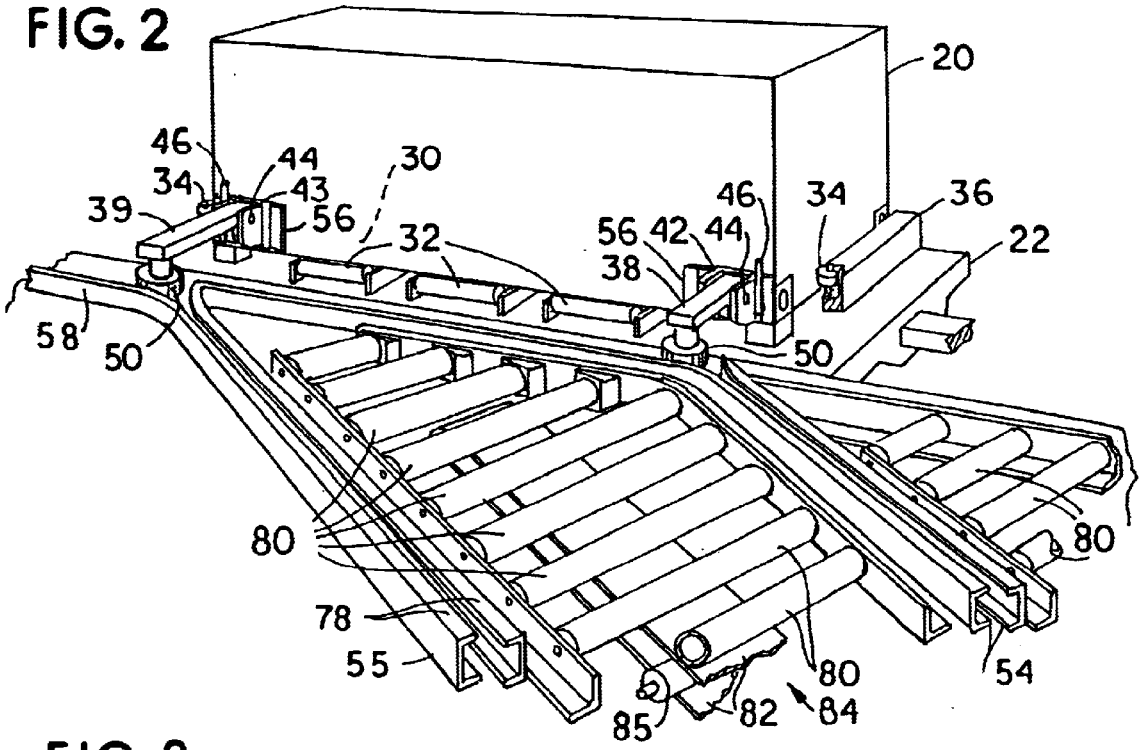
FIG. 2 is a partial perspective view of the car with container with coupling transfer arms engaging the channels on the platform with belt under roller conveyor.
Figure 3:
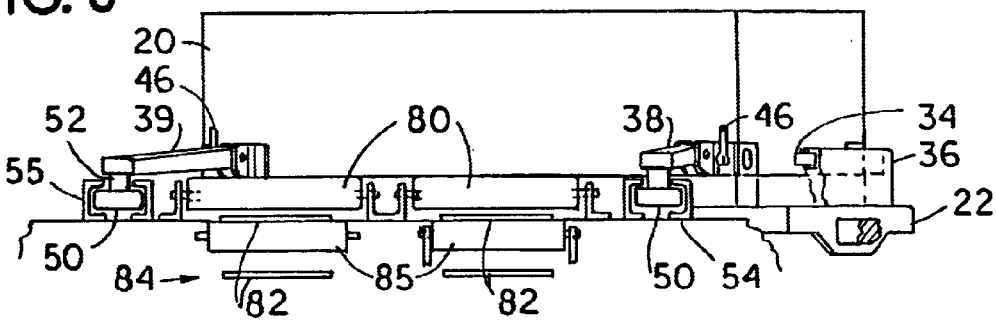
FIG. 3 is a sectional elevation in the direction 3 in FIG. 1.
Figure 4:
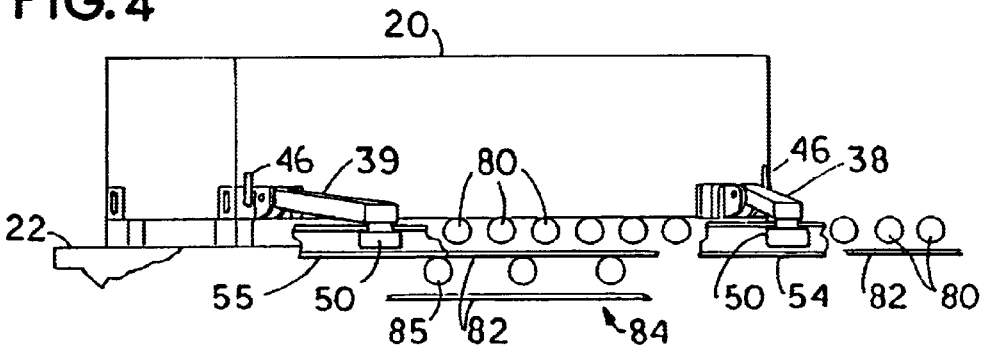
FIG. 4 is a side elevation of the container on the platform taken in the direction 4 in FIG. 1.

Referring to the drawings and in particular to FIGS. 1–4, cargo container 20 on car 22 in train 23 is shown traveling left to right on track 24. Transfer-storage platform run 26 is set up to receive containers 20 from trains from the left or send containers 20 on trains from the right. A second platform 26L is added in FIG. 1 on the far side of track 24 to receive containers 20 on trains from the right and send containers on trains from the left. A second set of platforms 27 and 27L are added so that a separate run can be used for incoming and outgoing containers as shown by directional arrows. Platform runs 26 and 27 interface driveway D, and platforms 26L and 27L interface driveway DL along their side opposite to track 24 for transfer of containers to and from trucks T. The platform runs can be long enough for storing containers as shown in FIG. 1, platform 26.

Car 22 has a roller bed or berth 30 with rollers 32 run lengthwise to support container 20 to roll in and out of the car transversely. The car has guide means such as rollers 34 mounted in a curb 36 secured across the car at the ends of the container berth to longitudinally guide the container in and out from either side of the car.

Roller arms 38 and 39 are detachably secured to the right and left end of each side of the container facing transfer, FIGS. 1–10. Arms 38 and 39 are each respectively mounted to a bracket 42 or 43 by a pin 44 to swing up and down between the side of the container and horizontal position extended out from the container. Each bracket 42 and 43 has a twist lock 46 with threaded shaft 47 for tight locking to a corner casting 48 on the container respectively on the right and left end of each side as viewed facing. Diagonally opposite lower right corners of the container would only receive brackets 42 while opposite left end lower comers would only receive brackets 43 as needed. Car 22 has retractable pins 49 for the comer castings 48 controlled to release the container when the arms are out on either or both sides of the container. Each arm 38 and 39 has a wheel 50 with ball hub 51 mounted on pin 52 secured depending from the arm in extended position to travel in a parallel channel track 54 or 55 respectively and run across each platform 26, 26L, 27 and 27L at a diagonal of 30° (preferably within 10–50°) from track 24 to pull the container out from the car as its rear curb rollers 34 push the container forward and out parallel to the car at 30° of translation. The container can have pull plates 56 added preferably recessed thereon to overlap the edge of brackets 42 and 43 to take the pull force on the side of the bracket opposite its twist lock.

Channel 54 extends from the track side edge of dock 26 at the right to the right at 30°. Channel 55 at the left extends from a wheel 50 space in from the edge of the dock to the right parallel to channel 54. A curbing 58 ahead of the channels along the dock prevents the container from rolling off the car when wheels 50 engage it before the transfer channels are reached. This curbing should extend along track 24 anywhere arms 38 and 39 are extended from the car before and after the dock.

Referring to FIGS. 5–10, car 22 has mid-parting side roll Lip-down doors 60 and 61 similar to those at floors of a freight elevator shaft. Car doors 60 control arms 38 and 39 to drop away from the side of the container when the door is opened. Arms 38 and 39 are lifted up against the container when the door is closed. A cam tab 64 on each arm 38 and 39 between pivot 44 and wheel 50 engages the bottom door 60 to swing up arms 38 and 39 as the door closes and holds them up until the door is opened. A second cam 66 on the end of each arm 38 and 39 on the opposite side of pivot 44 forces the arms to swing down when the door is opened. FIGS. 7–9 show in sequence the operation of lowering and lifting the arms by the door lowering and lifting. Arms 38 and 39 are lowered and lifted gently (without dropping to the platform) as seen in FIGS. 7–9 by channel on door 60 turned legs out controlling the lifting and lowering between cams 64 and 66 on the arms as the door lifts and lowers. Arms 38 and 39 can be left on the container for the trip on the train but removed after loading on a truck for highway clearance.

Arms 38 and 39, if attached on the far side of the container, preferably would not drop to horizontal position when the container is pulled out by the arms on the transfer side before the door 60 on the far side is opened. If they do drop they enter aligned open channels 74 and 75 for wheels 50 on arms 38 and 39 respectively on the far side to enter. Channels 74 and 75 are secured one channel width in from the driveway D side edge of the platform parallel to channels 54 and 55 to where a container is fully on the platform. The track and driveway sides of the dock are similar with channels 74 and 75 taking the place of channels 54 and 55 if the dock were turned around 180°. If the truck bed is equal to the car bed level, track 24 could be in pavement to use for both trains and trucks driven along track 24 close to the platform for transfer. Arms 38 and 39 should droop slightly below horizontal at the hinge joint to prevent horizontal forces from lifting them. Channels 54, 55, 74 and 75 have top legs 78 turned in with the gap between to confine wheels 50 from jumping out except where the arms are to be lifted. Arms 38 and 39 on the track side are lifted or removed before the container is put on car 22.

The container removed from the train is slowed as it skids or rolls along the platform. The platform preferably has rollers 80 run at right angles to the channels to support the container to roll in the direction of the channels. A belt 82 under rollers 80 accumulating conveyor 84 can be operated to retard and then position the containers and to individually move them to store or bring to transfer position for engaging a vehicle and can accelerate the container to coupling speed. Containers can be unloaded and reloaded while on the dock to trucks backed to the stepped left end of the dock.

From platform 26 the container can be loaded on a truck or semitrailer T, FIG. 1, driven left to right on driveway D after moving the container parallel along channels 54 and 55 and 74 and 75 to where wheel 50 on the rear arm 39 at the driveway extends into the path of the truck to be engaged by a roller curb 36T across the back of the trailer to move the container onto the truck's roller-bed RB. The container is secured by any suitable means and arms 38 and 39 removed before the truck is driven away.

The truck can deposit a container on the dock 26 by adding arms 38 and 39 to both sides of the container and driving past the dock right to left with arms 38 and 39 extended to engage the end of channel 74 and 75 respectively.

Telescoping Accelerating Frames

To be able to load containers as fast as the train can be unloaded, a separate accelerator 90, FIGS. 1 and 11–16, is provided to push start the container to train speed in alignment for the container to be pushed into its berth on the car. This can be in addition to the acceleration which conveyor 84 can provide and is simply accurate.

Accelerator 90 has a quadrant carriage frame 91 with wheels 92 in channel rails 94 below channels 54, 55, 74 and 75 on platform 26 parallel track 24 therealong, and has a pusher carriage frame 96 on wheels 92 in channels 94. The carriage frames 91 and 96 are rectangular in plan and have at each corner a depending leg 97 or 98 respectively each supported on wheels 92. The frames clear over rollers 80 and channels 54, 55, 74 and 75 on the platform and legs 97 and 98 track in a narrow clearance opening to channels 94. The rectangular frames are overlapped, frame 96 over 91, to telescope with a leg 97 to the right of (behind) each leg 98. Carriage frame 96 has a channel 100 of push rollers 101 across the left end and a transverse channel track 102 facing legs down across the right end at right angles to track 24. An accelerating arm, quadrant of a circle, 104 is pivotally supported at its central angle on a pivot post 105 on carriage 91 on top of its near left leg and above platform 26. Ann 104 has an upstanding pin 106 at the right end of the arc supporting a wheel 108 to run in channel 102. Quadrant arm 104 is turned by a tape of wire ropes 110 one end connected to arm 104 at pin 106 and run around the quadrant arc of arm 104 and tangent therefrom parallel track 24 to a carriage dog 112 on the channel 114 down along track 24 aways for an arm 116 extended from car 22 to engage the carriage 112 to pull the band and turn the quadrant arm 90° pulling carriage 96 to accelerate and push the container to train speed in alignment to enter the car and then moving both carriages until dog 112 disengages. Frame 96 has spring cushioned rollers 101 to push the container to travel the diagonal 30° while accelerating parallel to the train. After running in alignment at train speed for transfer, channel track 114 turns away from track 24 to clear dog 112 away from and disengage the car. A cable reel or other means can retract the carriages 91 and 96 to the right starting position clear for container movement on the dock. When dog 112 is engaged by the train from the right, carriage 91 is moved to the left until rollers 101 on frame 96 engage the container before the quadrant arm 104 is rotated to give substantially harmonic acceleration to the container.

Before acceleration, carriage dog 112 is located the quadrant radius distance ahead of the pivot axis of the quadrant arm 104 and the push plane of rollers 101 is located the quadrant arc length ahead of the quadrant arm pivot axis; so after accelerating dog 112 is even with the rollers and engages carriage 96 to keep this alignment for transfer. Arm 116 is located on the car to put rollers 34 and 101 in line for transfer after acceleration. Arm 116 is located a few inches behind rollers 34 to allow for thickness of parts.

A car is set for transfer after the platform is ready with container for the car, signaling a transducer on the car identifying through limit switches and speed governor that its berth is empty and speed safe before accepting signal to open doors 60–61 and extend arms 38 and 39 on that side and check that that is done before extending arm 116 by air cylinder 118, FIG. 53, retracted by spring after a time delay through an air bleed or other means.

Operation with Telescoping Accelerator

Figure 11:
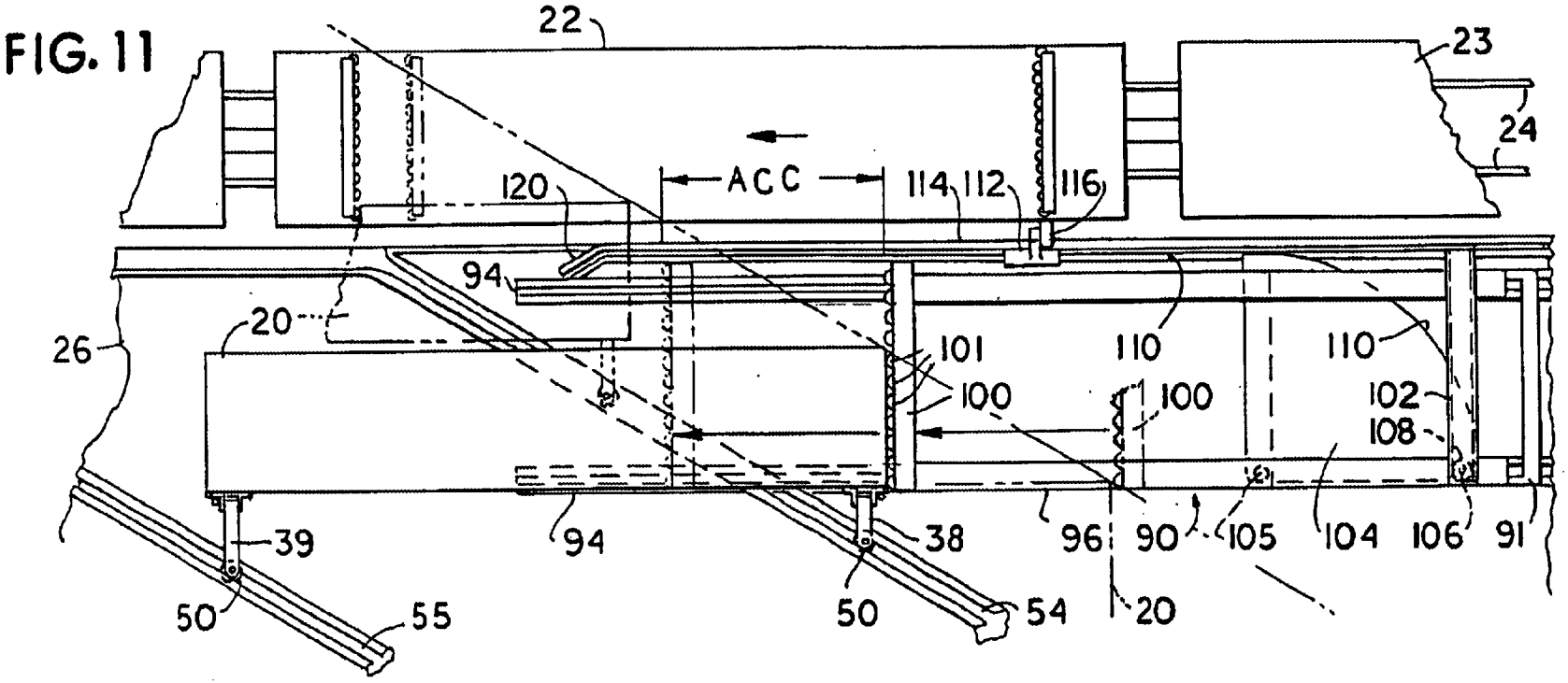
FIGS. 11 and 12 are respectively plan and side views of the right end of the platform with train moving right to left and an accelerator for starting a container to reach train speed in alignment for transfer.
Figure 12:
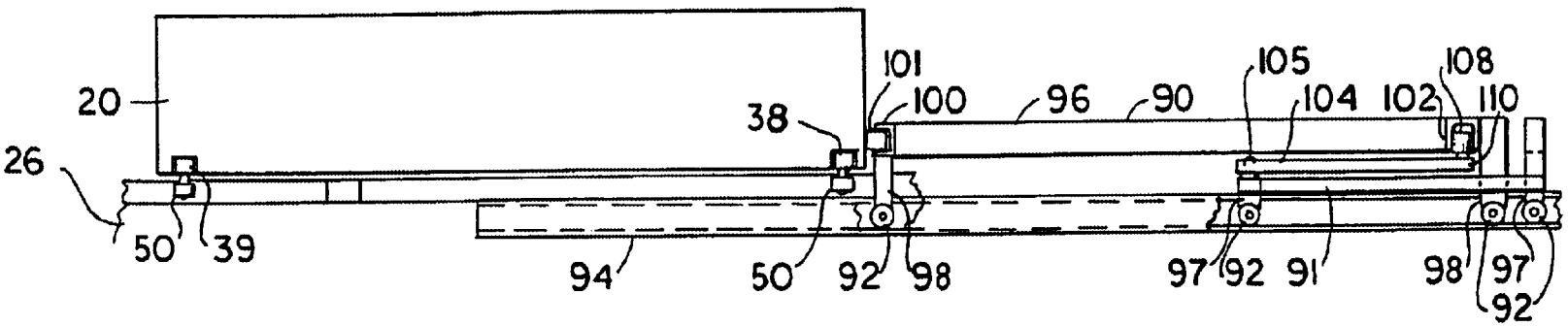

Before time for the train from the right the container is moved by diagonal conveyors 84 to position shown in FIG. 11, the accelerator 90 pushed against the container and dog 112 in start position ready for arm 116 on car 22 to engage to accelerate the container to train speed for transfer. The car in the train is set for transfer when its side doors along the container side are open, the container berth is empty and its arm 116 is extended to engage dog 112.

When dog 112 is engaged by arm 116 from the train from the right, quadrant arm 104 is turned counterclockwise, pulling roller wheel 108 along channel 102 as the wheel 108 travels the quadrant arc, accelerating the push carriage 96 and the container 20 against which the carriage 96 pushes to train speed at alignment to enter the berth on the car before dog 112 runs clear of the arm 116 where channel 114 it is on turns away from track 24. Arms 38 and 39 on the platform side follow channels 54 and 55 out their ends when the container is in place on the car as wheels 34 at the rear of the berth push the container into place on the car. Doors 60 are closed by signal from a wayside signal near the end of the platform, lifting arms 38 and 39 on the container, and the container is secured for train travel. The dog 112 and accelerator frames are moved to the right-hand end of their channel track for containers to clear. FIG. 16 shows positions at start of acceleration with part numbers and at train speed in phantom with the number plus prime.

There are many possible variations. Arms 38 and 39 could be made to roll or slide out and in on channels under the container. Channels 54 and 55 and 74 and 75 can have bends to change the transfer angle away from track 24 to store the containers in less space side by side.

Variations

Like parts are given the same reference number or a suffix added.

Referring to FIGS. 17 and 18, channels 54 and 55 are curved at 120 away 90° from track 24 where containers are clear of trains. These curves align containers 20 side by side between end curb rollers 34D mounted on vertical shafts extending up from the platform.

A simplified accelerator-decelerator 90D can then be used. It has an arm 104D pivoted at one end to swing on a vertical pivot 105 under platform 26 and an upstanding roller 108 on the opposite end to engage and retard or push a container 20 to train speed. The arm is mounted to swing in an arc of 90° from parallel track 24 where its roller 108 engages the rear of a container to accelerate it and swings to 90° forward with the roller remaining against the container to accelerate it substantially harmonically. A cable 110 is secured to the arm under roller 108 and runs around a horizontal pulley 124 ahead of where the arm will swing and back along track 24 to a reversing pulley 126 and is attached to dog 112 ahead of pulley 126. Dog 112 is mounted to roll or slide along track 114 parallel track 24 to beyond the swing of arm 104D. The dog is engaged by arm 116 extended from car 22 to receive a container at an empty berth. The dog is located as described with FIG. 16 to align roller 108 with rollers 34 at train speed when arm 104D is at right angles to track 24. The dog is disengaged when its track 114 carries it back from track 24 when arm 104D is substantially at right angles to track 24 when roller 108 is in line with rollers 34 at the rear of the berth for the container being pushed into the berth. The bottom of the ends of containers 20 are flat and straight, forming a track for rollers 34, 34D and 108 to roll on to guide and push on the containers as arm 104D turns. Arm 104D has a spur gear 130 secured thereon concentric about its pivot post 105. Gear 130 engages a smaller gear 132 on the shaft of an electric clutch connected to the shaft of gearmotor 136 driven to return arm 104 art and dog 112 to starting position for accelerating a container or for retarding an oncoming container.

Arm 104D decelerates a container pushed onto the platform when clear of the train. Its roller 108 is engaged by the forward end of the container where arm 104D is at right angles to track 24, forcing arm 104D to swing back, reducing the forward motion of the container to zero as the arm becomes parallel to track 24. Remaining momentum of the container is spent on accumulating conveyors or other retarding means where the containers are aligned side by side.

Referring to FIGS. 19–24, containers 20B of car width are transferred to dock 26B from train 23 moving to the right or from the dock to the train if moving to the left. Each car 22B has one or more container berths 30B each having a channel 140 or opening across near each end in which depending rollers 50 on a bridge arm 38B recessed across the bottom at each end of container 20B guide in or clear. Each arm 38B is supported to slide on retaining channels 141 secured along cross members that support the floor of the container. Each arm 38B has a roller 50 at each end on depending pins 52. The container 20B has a depending pin 142 through a slot 143 in arm 38B to limit extension of the arm from either side of the container to reach track 58 on the dock 26B. Each channel 140 has. a wide mouth 144 at each end with inward widing sides to receive a roller 50 with added tolerance when rolling against the side of the car. The sides of mouth 144 are widened inward to engage a roller 50 at an angle to pull the roller 50 in. A roller 50 in the channel entrance will keep another roller 50 out, FIG. 20.

Arm 38B is in section a box beam, FIG. 21, with top and bottom plates 146 and 147 extending out along the sides. The side edges of top plate 146 are engaged in grooved rails 141 secured to cross members of the container bed to support the arm to slide in and out the set distance each side of the container to align rollers 50 to engage the channels on the dock. The bottom plate 147 is substantially flush with the bottom of the container and has sprocket holes 150 along its bottom extensions the full length of the arm to be engaged by a sprocket 152 driven by gearmotor and electric clutch 154 secured to the car to extend and retract the arm. The ball hub 51 engages the floor of the dock or channel 54B to support container 20B from tipping when crossing the gap between the car and the dock.

Dock 26B has four parallel oblique channels 54B, two for the two rollers 50 on each arm 38B on each end of the container 20B. Channels 54B run at about 30° from the track back far enough to pull the container out away from the train as far as desired. The channels 54B for each end of the container are curved into one channel 54B' extending further from track 24 to align the containers side by side. The container is pushed out of the car when arms 38B are extended to the dock and engaged in the oblique channels 54B by the train moving to the right.

Referring to FIGS. 19 and 25 and 26, containers 20B can be auto racks which are stopped at high or low loading-unloading ramps 160 and 161 respectively at the dock for each end of the containers for each level on the auto rack so vehicles can be driven on and off at the same time.

Referring to FIGS. 27 and 28, passengers can be transferred to and from trains in containers 20P at platform 26, FIG. 1, while their autos are being transferred to or from the train in containers 201 at platform 26B, FIG. 19. Container 20P has the same cross section as its passenger car 22P above the floor. Car 22P has a berth 30P of near car length with ends tapered down and in at an angle to open clearance (about 10–30 from vertical). The container can have tapered end hoods as in FIGS. 82–88 of my pending patent application U.S. Ser. No. 09623,621. But preferably hoods 164 slide up and down on the tapered ends of the berth to seal and lift to open clearance between the car and container for roll-on - roll-off transfer. Each hood 164 is mounted on guide rollers 166 or slides to travel up and down on the end of the berth. A gear rack 16A, secured along the taper tapered end inside of each hood 164, is engaged by a gear 169 connected by shafting 170 bearing mounted across the end of the berth and connected by worm gear and worm drive motor 172 to raise and lower the hood. The car's enclosure extends at 174 under the hood to the clearance line to utilize this space.

This system makes it practical to put off and take on auto containers and passenger containers at intermediate stations with little delay and extend service beyond present terminal to terminal service.

Referring to FIGS. 27–33, car 22P can be the same width as bus B, FIGS. 29 and 30, for its container 20P to fit in berth 30P on bus B. The car and bus bodies each have extensions 174 in under hoods 164, which space can be utilized for passengers. End doors 176 on the container align end doors 177 on the extensions 174 for access to and from the container on both the car and bus or at the station.

Referring to FIGS. 27–30 and 33, arms 38P and 39P on each side of the container 20P are both secured parallel on shaft 180 along the side below the floor in the container to swing out together to horizontal and up past vertical. The arms on each side are lifted by a worm gear segment 182 preferably integral on the arm and centered and secured on shaft 180 and engaged by worm 184 driven by crank or gearmotor 186 to lift and lower the arms together and recess in pockets 190 and 191 in the side of the container.

In a typical operation, the bus is driven left to right along drive DL, FIG. 1, to deposit its container 20P on outbound platform 26L and is driven to the left end of driveway D to wait for an outbound train to leave a container 20P on platform 26 and take the container which was left by the bus to refill its berth. The bus is then driven to the right to take on the container and its passengers left by the train and arms 38P and 39P lifted for continuing travel on the bus. Horizontal rubber tired wheels 194 along platform 26L. FIG. 29, prevents the bus from scraping.

In FIG. 34 the dock 26V is a railway car or other vehicle and berth 30 is on a trailer 22T on driveway D alongside of dock car 26V. Three channels 54V run diagonally parallel across the bed of car 26V at each end spaced for rollers 50 to enter when arms 38C are extended from container 20B on trailer 22T. Arms 38C each have three inline rollers 50 spaced for the three channels 54V.

With arms 38B extended as in FIG. 34 to engage rollers 50 in channels 54V, either the truck is moved to the right or the car to the left for transfer. The container is respectively pushed or pulled off of the truck onto the car until clear of the truck. To complete a transfer when the speed was too slow, a cable 200 and winch 202 is secured at each end of vehicle 26V. The cable on the right (entering end) is hooked in standard comer castings on container 20B entering that end and the container pulled by winch 202 into place on vehicle 26V.

To transfer a container from vehicle 26V to truck 22T, the truck is turned around and driven right to left alongside of vehicle 26V. The container is unpinned and winched out toward the trailer. A hinged arm 116 is extended at the right to engage the vehicle 26V when moved to the left to transfer the container. Arm 116 is folded back to clear for highway operation. The winch cables are short to limit their movement of the container to a few feet so not to tip over the vehicle. The vehicles should be on straight and level track or driveway for transfer.

When the container is fully pushed over platform 26V, arms 38C extend as shown in phantom. Transverse channels 54T enable arms 38C to be pushed in tinder the container to clear for rail or highway operation of vehicle 26V. Longitudinal channels 54L are added so arms 38C can be left fully under the container when the container is engaged by and transferred to vehicle 22T. Otherwise they must be pulled out as shown in phantom to follow the same channels 54V for transfer both in and out. Arrows show the movement of rollers 50 in channels 54Y, 54T and 54L.

Referring to FIGS. 36–39, two-level passenger railway car 22PL has a lower container berth 30PL for container 20PL which extends across the car on the lower level. Berth 30PL has a door 177 at each end on the centerline of the car to align doors 176 central on the ends of container 20PL for passage to and from the transfer container. The berth has wheels 32W for supporting the container each side of doors 177 in a row across the car, interrupted by the door, and curb rollers 34 across each end below the door. The container his a ledge 208 across the too of each end for supporting it on wheels 32W to roll into and out from the berth. The container has arms 38P and 39P which recess into pockets on the sides of the container and engage in channels 54 and 55 respectively when extended to guide the container into and out from the car.

FIG. 40 shows a station for transfer of small containers 20S from and to train 23 in either direction past the station. Cars 22S in train 23 each have a plurality of container berths 30S each with rollers 32 for supporting a flat bottom container 20S having a length equal to the car's width and a width equal to that of a semitrailer.

The small containers 20S, FIGS. 40–44, are good for handling mail and express or autos or small vehicles which can be hoisted up at the front of the vehicle to an angle to fit in the short container crosswise the car.

Each container 20S has a transfer bridge arm 38C, as described, to slide out either end of container 20S out either side of car 22S that faces the station to engage rail 58 when approaching the station from either end that the train is entering. The station has a right and a left platform 26SR and 26SL the mirror image of each other with oblique channels 54 run at about 45° to track 24, a channel 54 for each wheel 50 on arm 38C. Each berth 30S has curb rollers 34 across the ends of the berth and a channel 140 positioned legs up central across the berth for rollers 50 to guide the container and rollers 32 lengthwise the car to support the container to roll in and out from either side of the car.

The dock has three channels 54 secured equally spaced to each receive a roller 50 in succession from the extended arm 38C of a container starting with the first channel met. Arm 38C is limited by pin 142 in slot 143 to pull the container out as the container is pushed toward the station by the train. As the container is pushed out further, the remaining rollers 50 engage in their respective channels 54 before the container is pushed clear of the train and is slowed down. Channels 54 turn parallel to track 24 where the container clears the trains and accumulates containers 20S when removed from the train. Preferably live roller accumulating conveyors 84 retard and drive the containers along the dock and when ready propel them to load on a train 23. The dock has a length for containers which are ready to be moved into empty berths 30S as the train continues in either direction. Roller 50 at the end of arm 38C facing the train is engaged with the car 22S and enters a channel 140 that is empty, since a container in that berth would have arm 38C with roller 50 blocking another roller 50 from entering that channel. At each end of the station a rubber tired roller 194 is mounted on the end of a lever arm 212 pivoted at 213 and biased by spring 214 to roll against the side of cars 22S to push in any container and roller 50 that may extend out from the car. When the containers are inserted in their berths they latch over catches or latches 216 alongside of each channel for rollers 50 across the berth. Arms 38C have catches 217 which also latch with latches 216 as will be described with FIGS. 46–49.

On the station platform, channels 54T intersect channels 54 at 90° for moving containers from conveyors 84 to a parallel conveyor 84 for storage or onto truck T backed to the dock. The truck bed has a central channel 54T' for rollers 50 to guide containers in and out of the truck on rollers 32 on the truck's bed. Channels 54T can be widened to give tolerance to truck alignment. Ball casters 218 can replace rollers 80 at these intersections.

Containers 20S have end roll-up doors 220 for unloading and reloading while on car 22S or on the dock. Roll-up doors 220 on both ends of containers 20S can be opened from both inside and out so when end to end on a truck or trailer they can be opened so fork truck FT can be driven through to load as one long container, FIG. 44.

The second run of accumulating conveyors 84SS can store containers 20S so trucks can load and unload therealong without interference with rail transfers.

Motors 154 are driven to extend arms 38, 38B or 38C on containers for transfer from the train on signal from a transponder code reader 224, FIG. 41, at the station which interrogates transponder 225 for each berth on the car 22, 22B or 22S to identify a container wanted for transfer to detect direction, speed, and loading of each berth. The reader is programmed to look for containers to be removed from the train. When found it signals the berth to unpin the container when safe for transfer and extend its arms 38 and 39 or 38B, 39B or 38C to engage the oblique channels for transfer.

The ends of containers 20S on cars 22S are flush with the car sides, FIG. 41. The car has a roof and ends to help contain the container and be streamlined. No car doors are needed except for empty berths. For this concern, roll-up doors 228 are provided guided in tracks 230 along each side of the berth to roll up into the roof area of the car to open an empty berth for a container on approach to the station to take a container therein. Opened doors 228 clear above the berth a path for a container. Closed doors 228 extend down to cover the empty berth area. Doors 228 stay open in berths having a container until the container is removed and the end of the station is approached where wayside control sends a signal to lock or pin the containers and close the doors of empty berths. Curb rollers 34 along each end of each berth guide containers straight in or out.

Referring to FIGS. 42 and 43, arm 38C has a catch finger or notch 217 from opposite ends on opposite sides to latch between latches 216 on the berth to hold the arm within the car. The flat container bottom has notches 238 to fit between latches 216 to secure the container centered on the car. The channel track 140 for arm 38C across the bottom of the container has a slot 240 in opposite legs for a trunion rod 242 on the inner portion of arm 38C to ride to limit extent of the arm from the container. A hand hook 244 can be used to lift and pull the arm out to unlatch and extend for transfer.

Referring to FIGS. 45–49 the small containers 20J preferably have arms 38J that extend from each side of each side with a roller 50 at each end of each side as do the long containers 20B. The arms 38—38 or 38–39 that extend from each side are connected by yoke J to insure operation together as one arm. The bottom of the container has an arm track channel along each end with a slot 240 in opposite facing walls. The inner end of each arm 38J has a trunion pin 242 supporting the arm to slide or roll along the slot which limits travel in and out from the container. The arms are retained by a bottom plate 245 on the container to keep the arms from drooping. Link 246 on right arm 38J and pin 247 on left arm 38J are engaged by the arm on the opposite side of the container to prevent arms from being extended from both sides of a container at the same time.

Arms 38J each have a notch catch 217 shown slotted and bent down toward and in from each roller 50 to engage behind a latch 216 on the car. The berth has four latches 216 one alongside each end of each channel 140 across the car. The top of each latch is tapered down to its side of the car to pass an arm 38J in to catch against the far latch 216. The bottom of the incoming container engages its recesses 238 between the latches 216. When the trailing arm 38J is pushed under the container, its catches 217 latch behind near side latches 216 on the car. Each latch 216 engages both the container and an arm. The arm is lifted on one side or the latch 216 lowered to extend with hand hook 244 or by a retractable motorized sprocket or air cylinders.

In FIGS. 50 and 51, arms 38 and 39 are omitted and a roller 50 mounted directly on each corner of the bottom of container 20S'. A gear rack 150' is recessed across the bottom of the container along the center line of its transverse axis relative to car 22S'. Gear rack 150' is engaged by spur gear 152' on gearmotor 154 secured to the car below the container to extend the container to align near rollers against guard rail 58 on dock 26S for entry into oblique parallel channels 54 as the car moves to the right.

Each berth on car 22S has a roller bed 32, channels 140 or clearing for rollers 50 to travel transversely across the car, a latch 216 for engaging in each comer notch 238 of the container 20S', and curb rollers 34 to guide the container straight across the car. Latches 216 are each supported by spring in an air cylinder that lowers its latch by air pressure on the side of the car for transfer. The latches have tapered tops and resiliently recess to pass an incoming container across the car to be stopped by the latches on the far side. The near side latches 216 then lift in notches 238 to secure the container in place.

Referring to FIG. 52, container 20S' has an arm 38H mounted on vertical pivot pin 44V to lift and swing out and drop between stop pins which hold the arm extended for its rollers 50 to engage in one channel 54 for transfer. Other arms 38M with rollers 50 can be on pins 44V fixed depending from the bottom of container 20S' to engage in parallel channels 54.

Referring to FIGS. 40 and 53, accumulating conveyors 84 are driven to carry containers to the train for loading in empty berths. Rollers 50 seek out empty channels 140 to find empty berths to enter while rolling on the side of the car along a protective rail for them. Preferably, as shown in FIGS. 40 and 53, each berth 30 has a pusher arm 116 extended on its trailing side to hold an incoming container away until aligned at an empty berth. The container is pushed by the next extended arm 116 and moves on the diagonal straight into the empty berth. Pusher arm 116 has a rubber covered roller 34' to roll against sides of the container and is located above curb rollers 34 on the car at height to clear the dock and is extended and retracted by air cylinder 118.

Referring to FIGS. 54–56, aim 38C is extended by one of two air chlinders 260, one for each direction, one below opposite sides and ends of the arm to clear rollers 50 and each other. The head end of each cylinder is clevis mounted to the car to move up and down. A cam roller 262 is connected by link 264 to the rod end to swing up and down on a cam track 266 secured to the car. Truck 266 lifts the rod end to engage the arm when the cylinder is pressured at the head end. The rod end engages a depending member 268 on arm 38C by track 266 lifting roller 262 at the start of the stroke and is held up by the cam roller to the end of the stroke when the arm 38C is thus extended for transfer. Then when cylinder 260 is exhausted it is returned by an internal spring, trailing link 264 to drop the rod below contact with arm 38C. At the end of tie return stroke, track 266 drops roller 262 to swing the link down to starting position.

Referring to FIG. 57 as a further variation, car 22A has an aisle 270 past berths 30S' for containers 20A. These narrow containers are more stable supported on bridging arms 38S that have swivel casters, FIGS. 58 and 59, with a central supporting wheel 276 and a steering roller 50 on each end of an extended caster frame 278. These casters follow in channels 54 or 55 substantially as described for rollers 50 and can support the container on arms 38S on wheels 276. Turntables in the channel track can redirect the containers to off and on load to vehicles backed to the side of the platform. All four casters are connected to turn together by roller chain and sprockets 280 or gearing and shafting so trailing casters are aligned to engage the channels when leaving the car. This type of arm is generally applicable.

Referring to FIG. 60, train 23 on track 24 is passing a station train of vehicles 26V and 26V' shown before and after transfer left to right. Vehicle 26V' is the mirror image of vehicle 26V with channels 54V on the opposite oblique angle for the rear vehicle 26V to receive a container from car 22 and the forward vehicle 26V' to deliver a container onto the same car while the train 23 passes the station train at a safe speed difference for the successive transfers.

Referring to FIG. 61, the container is preferably levitated by air pressure for transfer. Light controlled air solenoid valve nozzles 290 feed air from pressure tank 292 into corrals 294 under containers which cover and darken them to open to inject air for lifting the container thereabove. At night, electric lights 296 light the area to keep the nozzles closed except in the darkened corrals under a container when ready for transfer. The air corrals have an airtight base and side walls edged with fabric and rubber flaps 298 to engage the flat bottom of the container to confine air to build up pressure to lift the container. Light sensors 300 on the walls of these frames are connected to amplifier and relay to control valve 290 to close when lighted and open to admit air when darkened by a container thereover. Proximity switches could also be used. Rollers 80 in the corrals and along the edges of the platform can also support the container.

The container can be a flat bed, rack, gondola, special vehicle, or flat bed for carrying vehicles or other containers. This invention can be applied to material handling with the container, a parts box or flat bed, for loading and unloading amusement rides, and as a toy.

Having thus described my invention with preferred embodiments, I intend to cover by the claims all embodiments, variations, applications, and parts which are within the true spirit and scope of this invention.

What is claimed is:

1. A container transfer system comprising in combination, a vehicle way, at least one vehicle thereon for moving along said way, a container for transport on said vehicle, a platform at an elevation for receiving and supporting said container alongside of said way, said vehicle having at least one container berth for supporting and guiding said container to move transversely off of the vehicle onto said platform, a channel track having at least one channel secured on said platform extending obliquely away from said vehicle way, cam rider means for guiding on said channel including at least one roller supported extended from said container to engage in said channel to pull the container off of said vehicle onto said deck platform when the vehicle is moved along said way in the direction of increasing distance of said channel from said vehicle way, and means for supporting said container from the bottom on said platform to travel out from said vehicle parallel to said vehicle along said oblique channel.

2. A system as in claim 1 and means to move said container along on said best platform in the opposite direction into said container berth when the vehicle is moved in that direction along said way past said platform.

3. A system as in claim 2, said means to move being a push arm located on and extendable from said vehicle to engage and push said container along on said platform onto said berth when the vehicle is moved along said vehicle way past said platform in the direction of decreasing distance between said channel and said vehicle way.

4. A system as in claim 2, said means to move including an accelerating arm, a pivot support for the arm to swing horizontally thereon below the platform level, upstanding roller means on the end of said arm opposite said pivot to engage and push the container along said platform to harmonically accelerate the container as the arm is rotated, and means engaged by said vehicle along said vehicle way connected to rotate said arm to accelerate the container to align and enter said berth when moving in the second said direction.

5. A system as in claim 1 and latch means for securing said container on said berth and means for opening said latch means when said cam rider means is extended to release said container to move onto said platform.

6. In a system as in claim 1, said cam rider means having more than one said roller spaced for tracking in one said channel to keep the container parallel during transfer.

7. In a system as in claim 1, said container and vehicle being rectangular in plan withsides longer than width, there being at least one said roller extended from a side at each end of the container to engage and track in said channel track, said channel track having at least two said channels spaced apart parallel for the said roller for each end of the container to align in a said channel to align the container parallel and accurately to transfer between the vehicle and platform.

8. In a system as in claim 1, a second vehicle alongside of said vehicle way, said platform being the bed of said second vehicle and having a length along said vehicle way, said channel track having more than one said channel for each end of said container all parallel and oblique for the container, said container having a said roller spaced for each said channel and extended for engaging successively in the channels at each end as the container is transferred from the first said vehicle to said second vehicle so there is at least one said roller at each end of the container engaged in said channels while said container is engaged with said second vehicle.

9. A container side transfer system comprising in combination, a vehicle way, at least one vehicle thereon for moving along said vehicle way, at least one container, a platform for supporting said container alongside of said vehicle way, said vehicle having at least one berth for securing, supporting, and guiding a said container to move transversely on and off of said vehicle at an elevation for substantial level transfer to said platform, a cam channel track having spaced apart parallel channels secured on said platform extending obliquely away from said vehicle way, cam rollers spaced and supported extended each on a vertical axis depending from said container to engage in said channels to pull a said container parallelly off of said vehicle onto said platform when the vehicle is moved along said vehicle way passing said platform in the direction of increasing distance of said channel track from said vehicle way, and means for moving said container along said channel track into said berth when said vehicle is moved in the reverse direction past said platform.

10. A system as in claim 9, said container having arms extending from the side of said container each extending a said cam roller thereon to position to simultaneously enter a channel of said channel track for transfer of said container parallelly between said vehicle and said platform.

11. A system as in claim 10, said container having standard corner castings with holes, said arms each having twist-lock means for engaging in said holes to temporarily secure said arms to said container for transfer between said vehicle and said platform.

12. A system as in claim 10, said arms being hinged to swing up and down and means for lifting and lowering said arms for transfer.

13. A system as in claim 12, said means for lifting and lowering including cams on said arms and a longitudinal lift guard along the side of said vehicle to lift said arms and secure said container when raised, and when lowered, to engage said cams on said arms to lower said arms together to engage said rollers in said cam track for transfer.

14. In a system as in claim 10, said arms being mounted to slide in and out on the bottom of said container.

15. In a system as in claim 10, said arms being hinge mounted on said container to swing up and down, at least one of said arms having a worm gear segment concentric on its hinge and a worm engaged with said segment for lifting and lowering the arm, and means connecting said arms together to lift and lower together.

16. In a system as in claim 10, at least one vertical pin on said container, one of said arms being mounted thereon to swing its said roller thereon horizontally out from under said container, latch means for holding that arm extended to engage its roller in one of said channels and for holding the arm retracted to be within the clearance limits of said vehicle.

17. In a System as in claim 10, said arm being a bridging arm having both support and guide roller means for supporting said container to bridge the gap between said vehicle and said platform, and means for supporting said arm to give support for said container.

18. In a system as in claim 9, said channels being obliquely extended back from said way to clear the container from said vehicle, therebeyond each having a curve curving away from said vehicle way to guide said containers to be moved to align side by side.

19. In a system as in claim 18, said channels being duplicated and spaced for each end of the container.

20. A system as in claim 1, said vehicle being a railway car having a plurality of said berths each for a said container, said cam means including arm means extendable on each said container each having depending means to engage and align in said channel track in succession to pull out that container onto said platform.

21. In a system as in claim 20, said container being substantially as long as said railway car is wide and as wide as a highway vehicle for loading side-by-side on the railway car and end-to-end on a truck bed.

22. In a system as in claim 21, said container having a doorway on each end for throughput end loading by fork truck driving through container-after-container when aligned end-to-end on a highway vehicle, and door means for closing off said doorways to be sides on said railway car.

23. In combination, transport containers, railway track and cars thereon and highway vehicles for transporting said containers, a driveway for said highway vehicles, a dock for said containers having a side along said track and an opposite side along said driveway for transfer of said containers between said railway cars and said highway vehicles (such as trucks and buses), parallel transfer channels on said dock run oblique between said sides, said containers having cam wheels spaced and extended to engage and run in said channels to guide said containers parallel between said railway cars, said dock, and said highway vehicles, and means for moving said containers for transfer to and from said dock including the movement of said cars and said vehicles.

24. In a system as in claim 1, air corrals for lifting transfer containers on said platform comprising air pressure supply, light sensor controlled air valves to open in the dark to force air to enter in the corrals when under a said container to provide lift therefor to enable easier movement of the container on the platforms.

25. In a system as in claim 10, said arms being a bridging arms each having a swivel caster with a central support roller and a said cam roller on each end, and means for supporting the container on the arms for supporting the container bridging the gap between said vehicle and said platform, said support roller supporting each of said arms extended from said container guided by said cam rollers to travel along said channels on said platform.

26. A container transfer system having in combination a load bearing device (i.e. a container), a trackway, a vehicle guided to move along on said trackway, a dock for receiving said container from said vehicle when moving by along said trackway in a first direction, a berth on said vehicle for holding, guiding, and supporting said container to move transversely onto and off from said vehicle, a cam track on said dock oblique to said trackway, horizontal cam rider means on said container for engaging with said cam track for (switching) pulling said container parallelly off of said vehicle and onto said dock as said container is pushed along by said vehicle until clear from said vehicle.

27. A system as in claim 26 and means including a push arm mounted on said vehicle to extend therefrom to move said container in the opposite direction along said dock to push said container onto said berth as guided by said cam rider means along said cam track.

28. In combination, a vehicle way, a vehicle for running thereon, at least one container on said vehicle, a container transfer dock having a dock side &long said vehicle way to receive said container at substantially the same height as on said vehicle when thereat, a cam channel track on said dock extending obliquely substantially from said dock side away from said vehicle way, cam roller means on said container for engaging in said cam track along said dock to transfer the container to or from sail dock according to the direction of movement of said vehicle along said way, and roller means on said vehicle for pushing said container along said dock until clear of said vehicle, all said roller means guiding said container to roll straight parallel on and off of said vehicle, said cam track serving to pull out and push in said container on said vehicle and guide it parallelly on said dock, and conveying means on said dock for supporting, moving and stopping said container.

29. In combination, at least one transport container, a first and a second platform for holding said container for side transfer therebetween, at least one said platform being movable parallel alongside the other said platform, at least one oblique channel on said first platform extending on an oblique angle toward the second said platform, said second platform having means for guiding said container straight transversely onto and out from said second platform for this transfer, and aligning transfer means for engaging and connecting said container on (with) said channel at points spaced apart to travel parallel in line obliquely along said channel whereby the relative movement of said platforms alongside of each other transfers said container parallel between said platforms in a direction according to the direction of relative movement of said platforms alongside of each other.

* * * * *